US008698057B2

(12) United States Patent
Park et al.

(10) Patent No.: US 8,698,057 B2
(45) Date of Patent: Apr. 15, 2014

(54) VENTILATION HOODED MICROWAVE OVEN AND COOLING SYSTEM FOR THE SAME

(75) Inventors: Jun-Hyun Park, Changwon (KR); Yong-Ho Park, Changwon (KR); Wang-Lim Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 836 days.

(21) Appl. No.: 12/449,021

(22) PCT Filed: Dec. 17, 2007

(86) PCT No.: PCT/KR2007/006579

§ 371 (c)(1),
(2), (4) Date: Dec. 4, 2009

(87) PCT Pub. No.: WO2008/091061

PCT Pub. Date: Jul. 31, 2008

(65) Prior Publication Data

US 2010/0089910 A1 Apr. 15, 2010

(30) Foreign Application Priority Data

Jan. 26, 2007 (KR) ..... 10-2007-0008496
Mar. 9, 2007 (KR) ..... 10-2007-0023670
Mar. 9, 2007 (KR) ..... 10-2007-0023671

(51) Int. Cl.
*H05B 6/64* (2006.01)

(52) U.S. Cl.
USPC ..... 219/757; 219/756

(58) Field of Classification Search
USPC ..... 219/757
See application file for complete search history.

(56) References Cited

U.S. PATENT DOCUMENTS

| | | | | |
|---|---|---|---|---|
| 3,979,573 | A * | 9/1976 | Burns et al. | 219/739 |
| 6,707,019 | B2 * | 3/2004 | Kim | 219/757 |
| 2004/0134908 | A1 * | 7/2004 | Jeong | 219/757 |

FOREIGN PATENT DOCUMENTS

| | | | |
|---|---|---|---|
| KR | 200041670 | | 5/1989 |
| KR | 10-1997-0060240 | A | 8/1997 |
| KR | 20-1998-0030331 | U | 8/1998 |
| KR | 10-2000-0003825 | | 2/2000 |
| KR | 20-2000-0003825 | U | 2/2000 |
| KR | 10-2003-0073481 | | 9/2003 |
| KR | 10-2003-0097184 | | 12/2003 |
| KR | 10-2004-0019624 | | 3/2004 |
| KR | 10-2004-0061380 | A | 7/2004 |
| KR | 10-2005-0030374 | A | 3/2005 |
| KR | 10-2005-0046958 | | 5/2005 |

* cited by examiner

*Primary Examiner* — Johannes P Mondt
(74) *Attorney, Agent, or Firm* — McKenna Long & Aldridge, LLP

(57) ABSTRACT

Provided are a ventilation hooded microwave oven and a cooling system for the ventilation hooded microwave oven. In the ventilation hooded microwave oven, a pull-up door is provided, and various components of a cavity assembly, the pull-up door, and a door handle can be cooled by airflows induced by a cooling fan assembly. Therefore, outside areas of the ventilation hooded microwave oven can be efficiently used, and the ventilation hooded microwave oven can be reliably prevented from overheating.

17 Claims, 14 Drawing Sheets

VENTILATION HOODED MICROWAVE OVEN AND COOLING SYSTEM FOR THE SAME

This application is a 35 U.S.C. §371 National Stage entry of International Application No. PCT/KR2007/006579, filed on Dec. 17, 2007, and claims priority to Korean Application Nos. KR 10-2007-0008496, filed Jan. 26, 2007; KR 10-2007-0023670, filed Mar. 9, 2007, and KR 10-2007-0023671, filed Mar. 9, 2007, all of which are hereby incorporated by reference in their entireties.

TECHNICAL FIELD

The present disclosure relates to a ventilation hooded microwave oven, and more particularly, to a ventilation hooded microwave oven including a pull-up door for opening and closing a cooking chamber, and a cooling system for the ventilation hooded microwave oven.

BACKGROUND ART

Microwave ovens are household appliances used to cook foods using microwaves and heat. Generally, a microwave oven includes a cavity assembly and a door. The cavity assembly includes a cooking chamber, and one side of the door is rotatably fixed to the cavity assembly. Thus, the cooking chamber can be opened or closed by pulling or pushing the other side of the door.

Some microwave ovens (ventilation hooded microwave ovens) installed in furniture are designed to function as a hood for discharging smoke and fumes generated while food is cooked using a cooker disposed under the microwave oven. A display unit can be installed in a door of a microwave oven to receive commands from a user and display information about the operation of the microwave oven.

However, such microwave ovens of the related art have disadvantages as follows.

Since the cooking chamber is opened or closed by rotating the other side of the door forward or backward, it is inconvenient to place articles at both sides of the microwave oven when the door pulled for opening the cooking chamber.

Furthermore, the door is movable after it is pulled for opening the cooking chamber. Therefore, it is inconvenient to place food into the cooking chamber and take the food out of the cooking chamber owing to the movable opened door.

In the case of the ventilation hooded microwave oven installed in furniture, a hinge assembly used to attach a door to a cavity assembly is disposed within the furniture. Therefore, the whole microwave oven should be first detached from the furniture to separate the door from the cavity assembly.

Furthermore, due to a passage formed in the cavity assembly of the ventilation hooded microwave oven for discharging smoke and fumes, spaces for other electric components are insufficient.

Moreover, the ventilation hooded microwave oven should be first detached from the furniture when repairing or replacing electric components or other components of the ventilation hooded microwave oven.

Meanwhile, a door of a microwave oven can be overheated while food is cooked in a cooking chamber. Therefore, a user can be injured when holding the door, and a display unit installed in the door can be damaged by heat.

DISCLOSURE OF INVENTION

Technical Problem

Embodiments provide a door for a ventilation hooded microwave oven, the door being designed so that surrounding spaces of the door can be efficiently used.

Embodiments also provide a door for a ventilation hooded microwave oven, the door being designed so that food can be placed into and taken out of the ventilation hooded microwave oven more easily.

Embodiments also provide a door for a ventilation hooded microwave oven, the door being designed so that a sufficiently large space can be allocated for an electric component room.

Embodiments also provide a door for a ventilation hooded microwave oven, the door being designed so that a display unit disposed in the door can be reliably protected.

Embodiments also provide a door for a ventilation hooded microwave oven, the door being designed so that the possibility of accidents can be reduced.

Technical Solution

In one embodiment, there is provided a ventilation hooded microwave oven having a cavity assembly and a door, the cavity assembly having a cooking chamber for cooking food and an electric component room in which a plurality of electric components is disposed, the door being rotatably attached to the cavity assembly such that a lower end portion of the door is rotatable upward or downward about an upper end portion of the door to open or close the cooking chamber, the ventilation hooded microwave oven being characterized in that the ventilation hooded microwave oven includes: a cooling fan assembly generating power to create flows of air into and out of the cavity assembly; a vent grill at a front side of the cavity assembly to guide air into and out of the cavity assembly; and an interference preventing portion at a rear side of the door to prevent an interference between the door and the vent grill when the door is rotated to selectively close and open the cooking chamber.

In another embodiment, there is provided a ventilation hooded microwave oven having a cavity assembly and a door, the cavity assembly having a cooking chamber for cooking food and an electric component room in which a plurality of electric components is disposed, the door having a door handle at a front side and being rotatably attached to the cavity assembly such that a lower end portion of the door is rotatable upward or downward about an upper end portion of the door to open or close the cooking chamber, the ventilation hooded microwave oven being characterized in that the ventilation hooded microwave oven includes: a cooling fan assembly generating power so as to force air to flow into and out of the door and then into and out of the cavity assembly; a vent grill at a front side of the cavity assembly so as to guide air flowing from the door to the cavity assembly and to guide air discharged from the cavity assembly; and an interference preventing portion at a rear side of the door so as to prevent an interference between the door and the vent grill when the door is rotated to selectively close and open the cooking chamber.

In a further embodiment, there is provided an airflow system for a ventilation hooded microwave oven having a cavity assembly in which a cooking chamber is disposed and a door configured to selectively open and close the cooking chamber, the airflow system including: a cooling fan assembly configured to force air to flow into the door and the cavity assembly and then out of the cavity assembly after the air cools electric components and is circulated in the cooling chamber; a vent fan assembly configured to introduce fumes from food cooked on a cooker disposed under the cavity assembly into the cavity assembly and discharge the fumes from the cavity assembly; and a vent grill through which flows of air and fumes induced by the cooling fan assembly and the vent fan assembly are discharged from the cavity assembly.

Advantageous Effects

The present disclosure provides efficient use of surrounding spaces of a microwave oven, easy loading and unloading of food to and from a cooking chamber of the microwave oven, each detachment of a door of the microwave oven, a sufficiently large room for an electric component room of the microwave oven, easy repair and replacement of components of the microwave oven, reliable protection for a display unit of the door, and reliable prevention of accidents.

BEST MODE FOR CARRYING OUT THE INVENTION

A ventilation hooded microwave oven and a cooling system for the ventilation hooded microwave oven will now be described in detail with reference to the accompanying drawings according to a first embodiment.

Figure 1:
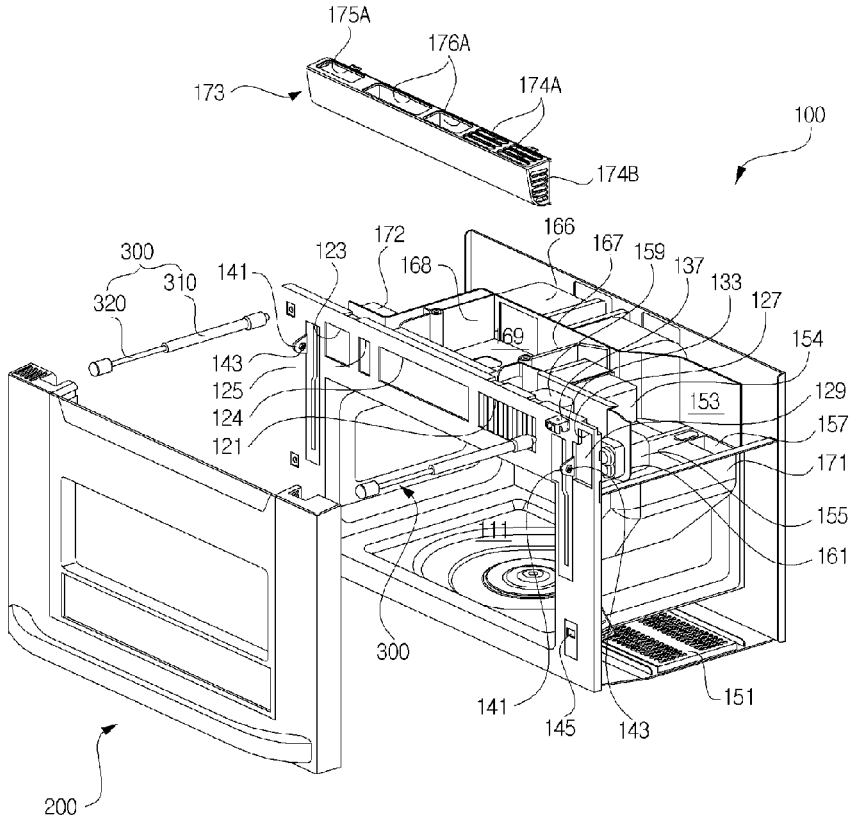
FIG. 1 is an exploded perspective view illustrating a ventilation hooded microwave oven according to a first embodiment.
Figure 2:
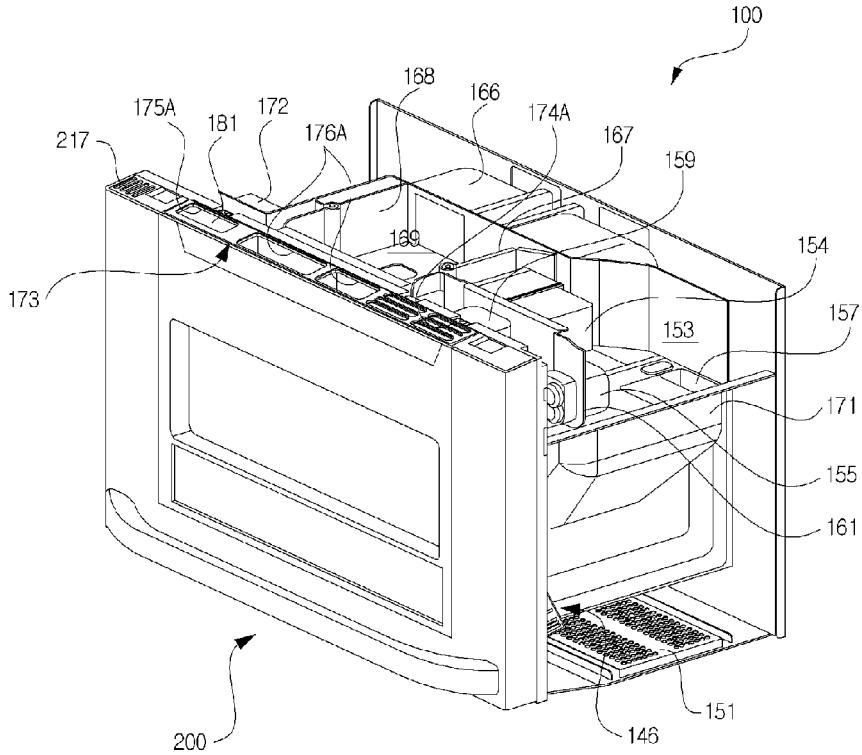
FIG. 2 is a perspective view illustrating an assembled state of the ventilation hooded microwave oven according to the first embodiment.
Figure 3:
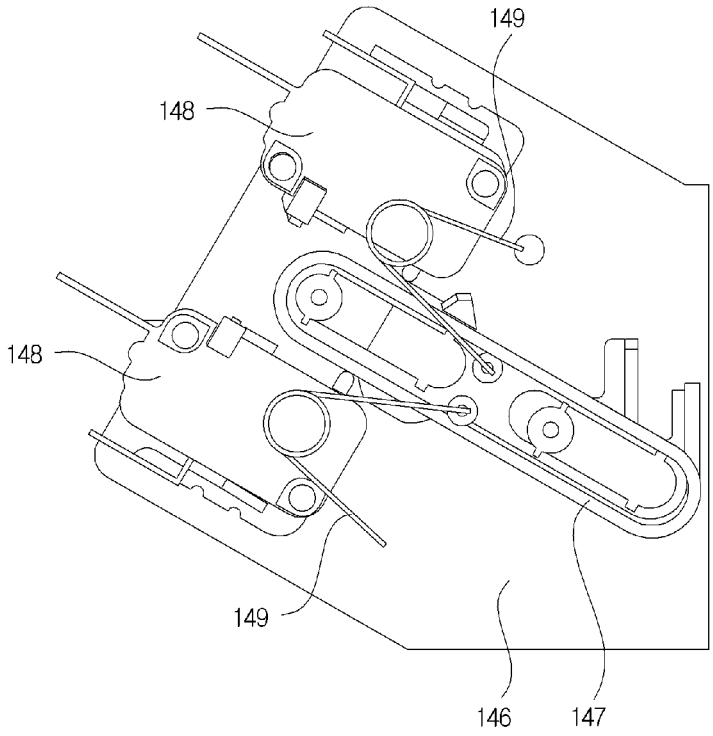
FIG. 3 is a vertical sectional view illustrating a latch board of the ventilation hooded microwave oven according to the first embodiment.
Figure 4:
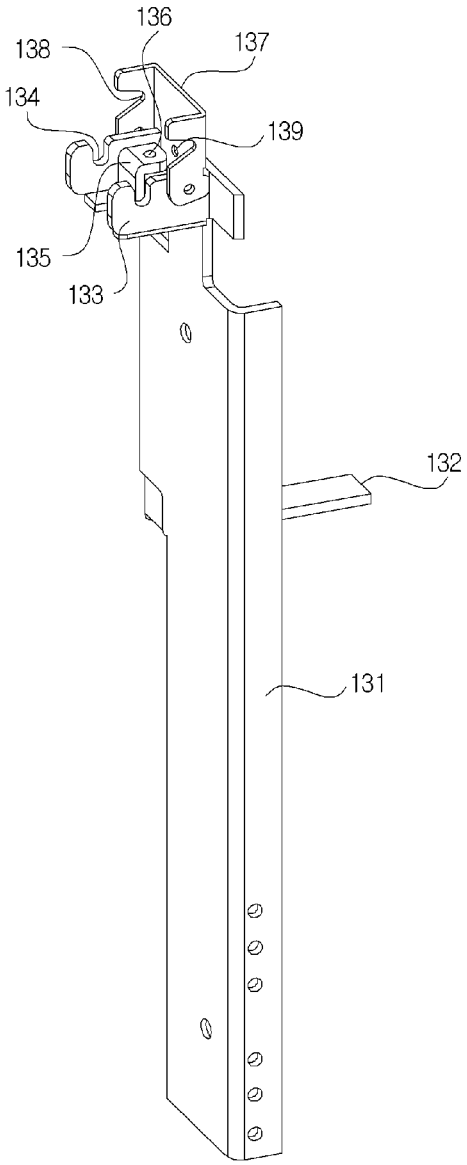
FIG. 4 is a perspective view illustrating a door support bracket of the ventilation hooded microwave oven according to the first embodiment.
Figure 5:
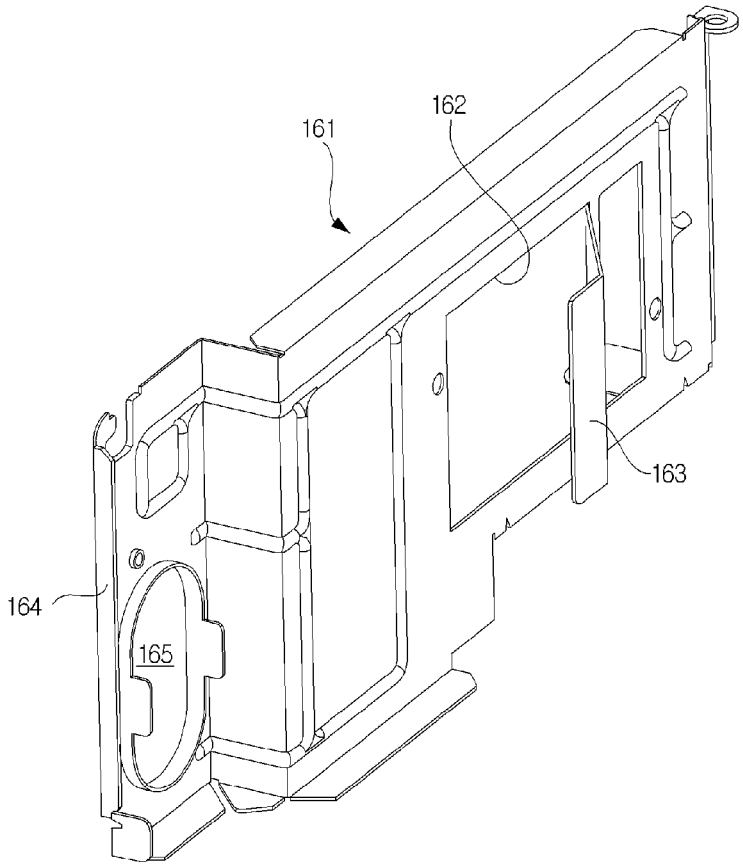
FIG. 5 is a perspective view illustrating an air barrier of the ventilation hooded microwave oven according to the first embodiment.
Figure 6:
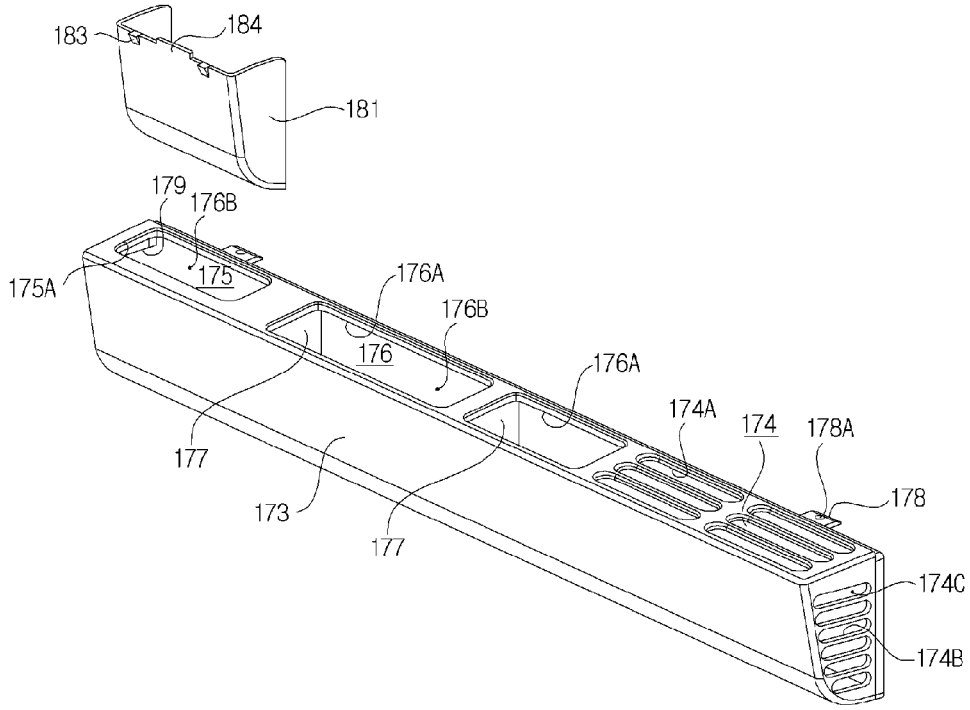
FIG. 6 is a perspective view illustrating a vent grill and a lead wire cap of the ventilation hooded microwave oven according to the first embodiment.
Figure 7:
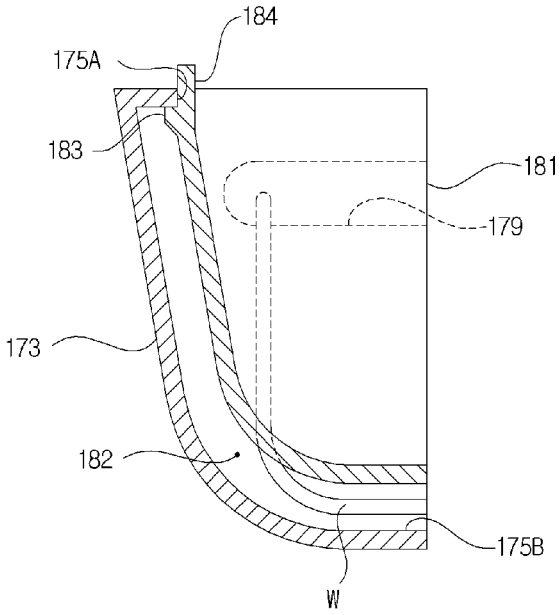
FIG. 7 is a vertical sectional view illustrating an assembled state of the vent grill and the lead wire cap according to the first embodiment.
Figure 8:
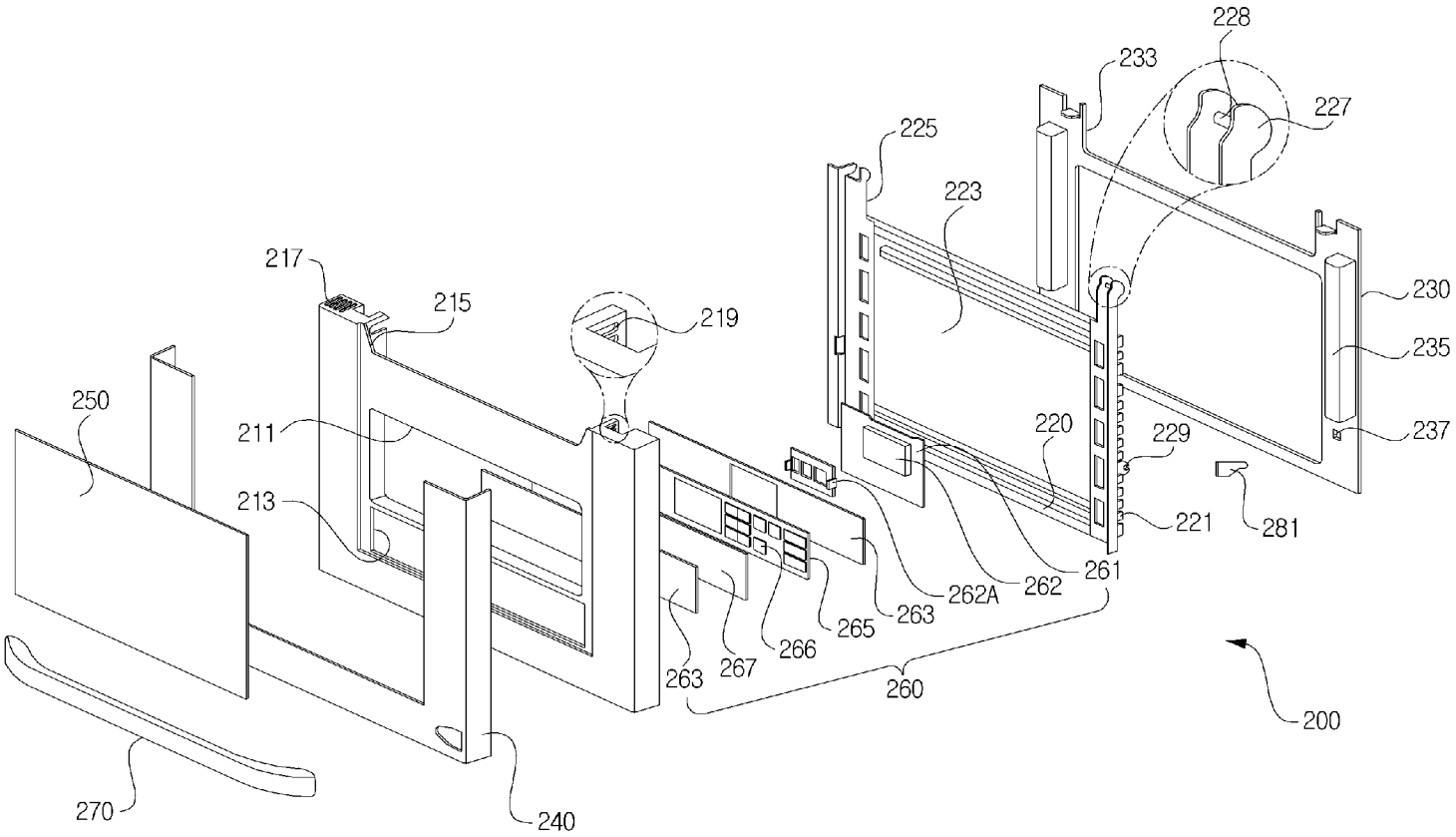
FIG. 8 is an exploded perspective view illustrating a door of the ventilation hooded microwave oven according to the first embodiment.
Figure 9:
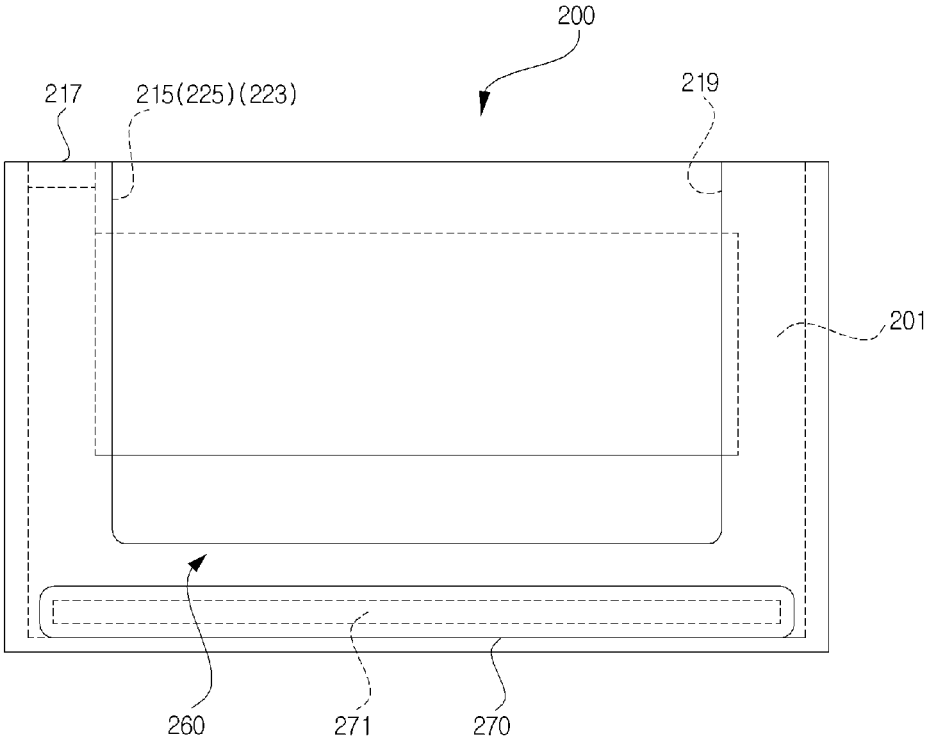
FIG. 9 is a front view illustrating the door according to the first embodiment.

FIG. 1 is an exploded perspective view illustrating a ventilation hooded microwave oven according to a first embodiment, and FIG. 2 is a perspective view illustrating an assembled state of the ventilation hooded microwave oven according to the first embodiment. FIG. 3 is a vertical sectional view illustrating a latch board of the ventilation hooded microwave oven according to the first embodiment, and FIG. 4 is a perspective view illustrating a door support bracket of the ventilation hooded microwave oven according to the first embodiment. FIG. 5 is a perspective view illustrating an air barrier of the ventilation hooded microwave oven according to the first embodiment, and FIG. 6 is a perspective view illustrating a vent grill and a lead wire cap of the ventilation hooded microwave oven according to the first embodiment. FIG. 7 is a vertical sectional view illustrating an assembled state of the vent grill and the lead wire cap according to the first embodiment, and FIG. 8 is an exploded perspective view illustrating a door of the ventilation hooded microwave oven according to the first embodiment. FIG. 9 is a front view illustrating the door according to the first embodiment.

Referring to FIGS. 1 to 9, a cooking chamber 111 is formed in a cavity assembly 100 of the ventilation hooded microwave oven (hereinafter, also referred to as a microwave oven). The cooking chamber 111 is a room for cooking food and is selectively opened and closed by a door 200.

A plurality of inlet holes 113 (refer to FIG. 20) is formed in a side portion of the cooking chamber 111, and a plurality of outlet holes 115 (refer to FIG. 20) is formed in the topside of the cooking chamber 111. The inlet holes 113 are formed in the right side of the cooking chamber 111 when viewed in FIG. 20 for introducing air into the cooking chamber 111. When viewed in FIG. 20, the outlet holes 115 are formed in a right edge portion of the topside of the cooking chamber 111 away from the inlet holes 113 for discharging air from the cooking chamber 111.

An inlet portion 121 and an outlet portion are formed in a front upper side of the cavity assembly 100. The inlet portion 121 is formed in one side of the front upper side of the cavity assembly 100 (the right side of the front upper side of the cavity assembly 100 when viewed in FIG. 1). The inlet portion 121 allows air used to cool the door 200 to be introduced into the cavity assembly 100. The outlet portion includes a first outlet 123 and a second outlet 124. The first outlet 123 is formed in the other side of the front upper side of the cavity assembly 100 opposite to the inlet portion 121. That is, the first outlet 123 is formed in the left side of the front upper side of the cavity assembly 100 when viewed in FIG. 1. The second outlet 124 is formed in a center portion of the front upper side of the cavity assembly 100 between the inlet portion 121 and the first outlet 123. Air is discharged from the cavity assembly 100 through the first outlet 123. Smoke and fumes, which are generated from food cooked on a cooker disposed under the microwave oven and introduced into the cavity assembly 100, are discharged from the cavity assembly 100 through the second outlet 124 when a vent fan assembly 166 (described later) operates.

A terminal opening 125 is formed in the front upper side of the cavity assembly 100 between the first outlet 123 and the second outlet 124. A terminal housing (not shown) is coupled to the cavity assembly 100 through the terminal opening 125. The terminal housing protrudes forward from the cavity assembly 100. A terminal (not shown) may be connected to the terminal housing to transmit power and various signals to a display unit 260 of the door 200.

A service opening 127 is formed in a portion of the front upper side of the cavity assembly 100 opposite the outer portion. That is, the service opening 127 is formed at the right of the inlet portion 121. A capacity 155 (described later) can be replaced through the service opening 127. Thus, the size and the shape of the service opening 127 are determined based on the size of the capacity 155. The service opening 127 can be selectively opened and closed by an opening/closing bracket 129. The opening/closing bracket 129, that is the service opening 127, is exposed when the door 200 rotates to open the cooking chamber 111. In other words, the service opening 127 is formed in a portion of the cavity assembly 100 that makes contact with a rear surface of the door 200 when the cooking chamber 111 is closed by the door 200.

Door support brackets 131 are disposed in both sides of the front surface of the cavity assembly 100, and a detailed view of the door support bracket 131 is shown in FIG. 4. The door support brackets 131 support the door 200 and allow rotation of the door 200. Each of the door support brackets 131 has a L-shaped cross section and is vertically elongated. When assembled, front surfaces of the door support brackets 131 make tight contact with both sides of a front inner surface of the cavity assembly 100. A fixing rib 132 is formed on a rear surface of the door support bracket 131. When assembled, the fixing rib 132 is fixed to a top surface of the cavity assembly 100. The door support bracket 131 includes a hinge bracket 133 and a hinge cover 137.

The hinge bracket 133 is formed on a front upper portion of the door support bracket 131. When assembled, the hinge bracket 133 protrudes forward from a lateral side of the front surface of the cavity assembly 100. The hinge bracket 133 is U-shaped with an opened top and protrudes forward from the lateral side of the front surface of the cavity assembly 100 when the door support bracket 131 is coupled to the cavity assembly 100. Here, the protruded length of the hinge bracket 133 from the cavity assembly 100 is adjusted such that a predetermined portion (i.e., a coupling hole 136) of the hinge bracket 133 is exposed to the outside when the microwave oven is installed in furniture above a cooker.

The hinge bracket 133 includes hinge grooves 134 in both sides. The hinge grooves 134 are vertically formed in top surfaces of both sides of the hinge bracket 133. The hinge grooves 134 receive a hinge pin 228 (described later). The hinge pin 228 can be inserted into the hinge grooves 134 from the top of the hinge bracket 133.

A coupling flange 135 is disposed at the hinge bracket 133. The coupling flange 135 can be formed by cutting a horizontally elongated bottom portion of the hinge bracket 133 into a rectangular shape and bending the cut portion into an L-shape. The coupling hole 136 is formed in a top surface of the coupling flange 135 for fixing the hinge cover 137 to the hinge bracket 133. The coupling hole 136 formed in the top surface of the coupling flange 135 is exposed to the outside when the microwave oven is installed in furniture.

The hinge cover 137 is disposed at a top portion of the door support bracket 131 above the hinge bracket 133. When the door support bracket 131 is coupled to the cavity assembly 100, the hinge cover 137 protrudes forward through a lateral side of a front upper portion of the cavity assembly 100. The hinge cover 137 is U-shaped and has a downwardly opened side. The hinge cover 137 is rotatable on its rear edge. Thus, when the hinge pin 228 is inserted into the hinge grooves 134, the hinge cover 137 can be rotated down to securely hold the hinge pin 228 in the hinge grooves 134.

For this, hinge pin openings 138 are formed in both lower sides of the hinge cover 137. The hinge pin openings 138 can be formed by partially cutting both lower sides of the hinge cover 137 into a downwardly sloped shape. When the hinge cover 137 is rotated down, the hinge pin 228 inserted in the hinge grooves 134 is inserted into the hinge pin openings 138.

After the hinge cover 137 is rotated down (i.e., when the hinge pin 228 is inserted into the hinge pin openings 138), the hinge bracket 133 is disposed inside the hinge cover 137. In this state, both upper sides of the hinge bracket 133 make tight contact with inner surfaces of the hinge cover 137.

A penetration hole 139 is formed through a top surface of the hinge cover 137. After rotating down the hinge cover 137 to hold the hinge pin 228 in the hinge grooves 134 of the hinge bracket 133, a screw (S) (refer to FIG. 12) can be fixed to the coupling hole 136 of the hinge bracket 133 through the penetration hole 139 of the hinge cover 137 to prevent movement of the hinge cover 137. For this, when the hinge cover 137 is rotated down (i.e., when the hinge cover 137 holds the hinge pin 228 in the hinge grooves 134), the penetration hole 139 of the hinge cover 137 is aligned with the coupling hole 136 of the hinge bracket 133. Thus, the penetration hole 139 of the hinge cover 137 as well as the coupling hole 136 of the hinge bracket 133 is exposed to the outside when the microwave oven is installed in furniture.

Spring fixing portions 141 protrude forward from both front sides of the cavity assembly 100. The spring fixing portions 141 are located under the hinge covers 137 when the door support brackets 131 are coupled to the cavity assembly 100. Gas springs 300 (refer to FIG. 1) are fixed to the spring fixing portions 141. The spring fixing portions 141 are fixed to the door support brackets 131 disposed in the cavity assembly 100 and protrude forward from both front sides of the cavity assembly 100 by a predetermined length. Each of the spring fixing portions 141 includes a horizontal spring fixing protrusion 143.

Latch slots 145 are disposed at both sides of a lower front surface of the cavity assembly 100. The latch slots 145 can be formed by partially cutting out both sides of the lower front surface of the cavity assembly 100 into a horizontally elongated rectangular shape. The latch slots 145 receive latch protrusions 281 (refer to FIG. 8).

A latch board 146 is disposed in the cavity assembly 100 at a position corresponding to the latch slot 145, and a detailed view of the latch board 146 is shown in FIG. 3. The latch board 146 includes an actuation lever 147, a pair of latch switches 148, and a pair of torsion springs 149. When the door 200 is closed, the actuation lever 147 locks the latch protrusion 281 inserted in the latch slot 145 to hold the door 200 in closed position, thereby preventing undesired opening of the cooking chamber 111. When the actuation lever 147 is moved backward along an upwardly sloped path by the latch protrusion 281 inserted into the latch slot 145, the latch switches 148 are turned on. When the actuation lever 147 is moved forward along the sloped path, the latch switches 148 are turned off. The latch switches 148 are turned on or off by the actuation lever 147 to start or end the operation of the microwave oven. One end of the torsion spring 149 is fixed to the actuation lever 147, and the other end of the torsion spring 149 is fixed to the latch board 146. Thus, the actuation lever 147 can be moved forward along the sloped path by an elastic force of the torsion spring 149. That is, when the latch protrusion 281 is drawn back from the latch slot 145, the actuation lever 147 is automatically moved forward along the sloped path by the torsion spring 149.

A smoke inlet portion 151 is formed in a bottom surface of the cavity assembly 100. Smoke and fumes generated from food cooked on a cooker disposed under the microwave oven are introduced into the cavity assembly 100 through the smoke inlet portion 151 by operation of the vent fan assembly 166. A filter (not shown) can be disposed on the smoke inlet portion 151 for collecting particles and pollutant substances from the smoke and fumes.

An electric component room 153 can be disposed at an upper lateral portion of the cavity assembly 100 behind the inlet portion 121. In FIG. 1, the electric component room 153 is disposed at the upper right side of the cavity assembly 100. The electric component room 153 contains various electric components such as a magnetron 154 and a capacitor 155. Such electric components disposed in the electric component room 153 are used to generate microwaves for cooking foods. An opening 157 is formed in a bottom surface of the electric component room 153. Air used to cool the electric components of the electric component room 153 is guided to the cooking chamber 111 through the opening 157.

A cooling fan assembly 159 is disposed in a front upper portion of the cavity assembly 100 close to the inlet portion 121. The cooling fan assembly 159 is used to generate airflows for cooling the door 200, cooling the electric components of the electric component room 153, and removing moisture, gaseous fatty substances, and odors generated from food cooked in the cooking chamber 111. A suction portion of the cooling fan assembly 159 is disposed close to the inlet portion 121, and a discharge portion of the cooling fan assembly 159 is disposed toward the electric component room 153. In FIG. 1, the discharge portion of the cooling fan assembly 159 is disposed backward.

An air barrier 161 is disposed between a front upper portion of the cavity assembly 100 and the electric component room 153. The air barrier 161 is a border structure between the electric components of the electric component room 153 and the cooling fan assembly 159. An airflow generated by operation of the cooling fan assembly 159 is guided to the electric components of the electric component room 153 by the air barrier 161. As shown in FIG. 5, the air barrier 161 can be formed of a metal and have a rectangular shape having a predetermined length.

The air barrier 161 includes an air supply opening 162 to guide air discharged from the discharge portion of the cooling fan assembly 159 to the electric component room 153. The air barrier 161 further includes a guide 163 to efficiently guide air from the air supply opening 162 to the electric components of the electric component room 153, particularly, to the magnetron 154 of the electric component room 153. In the current embodiment, the guide 163 is formed by cutting a portion of the air barrier 161 into a rectangular shape to form the air supply opening 162 and bending the cut portion toward the magnetron 154.

The air barrier 161 further includes a component mount portion 164 on one side. The component mount portion 164 is formed by bending a portion of the air barrier 161 several times toward the front surface of the cavity assembly 100. A component installation hole 165 is formed in the component mount portion 164. The component installation hole 165 is formed by cutting out a portion of the component mount portion 164 corresponding to the service opening 127 of the cavity assembly 100 into a shape corresponding to a component (e.g., the capacitor 155 of the electric component room 153) to be installed in the component installation hole 165.

The vent fan assembly 166 is disposed in a rear side of a top portion of the cavity assembly 100 behind the second outlet 124. Smoke and fumes introduced into the cavity assembly 100 from food cooked on a cooker disposed under the microwave oven are discharged forward from the cavity assembly 100 by operation of the vent fan assembly 166. For this, an inlet portion of the vent fan assembly 166 faces both sides of the cavity assembly 100, and an outlet portion of the vent fan assembly 166 faces a front side of the cavity assembly 100 (i.e., the second outlet 124 of the cavity assembly 100).

First and second air guides 167 and 168 are disposed at the top portion of the cavity assembly 100 between the second outlet 124 and the vent fan assembly 166. Each of the second air guides 167 and 168 extends at the top portion of the cavity assembly 100 in a front-to-back direction to form a vent passage 169 for discharging smoke and fumes from the cavity assembly 100 through the second outlet 124 when the vent fan assembly 166 operates.

In FIG. 1, the first air guide 167 is disposed at the right of the vent passage 169 between the electric component room 153 and the vent fan assembly 166. Practically, the first air guide 167 separates the electric component room 153 and the vent fan assembly 166. The first air guide 167 is formed of metal and is L-shaped and covers lateral and rear sides of the electric component room 153. The first air guide 167 is sloped leftward toward the second outlet 124 so that the cross sectional area of the vent passage 169 decreases as it goes toward the second outlet 124. In other words, the vent passage 169 is narrowed by the electric component room 153.

A first air duct 171 is disposed at a side of the cavity assembly 100. Air introduced into the cavity assembly 100 by the cooling fan assembly 159 to cool the electric components of the electric component room 153 is guided to the cooking chamber 111 by the first air duct 171. For this, the first air duct 171 is disposed at a right side of the cavity assembly 100 under the electric component room 153 and is connected to the inlet holes 113 and the opening 157.

A second air duct 172 is disposed at a side of the top portion of the cavity assembly 100. Air circulating in the cooking chamber 111 is guided to the first outlet 123 by the second air duct 172. The second air duct 172 is disposed at a left side of the top portion of the cavity assembly 100 above the cooking chamber 111 and communicates with the outlet holes 115 and the first outlet 123.

A vent grill 173 is disposed at a front portion of the cavity assembly 100 corresponding to the inlet portion 121 and the first and second outlets 123 and 124. The vent grill 173 guides air to the inlet portion 121 of the cavity assembly 100. Furthermore, the vent grill 173 guides air discharged through the first and second outlets 123 and 124.

As shown in FIG. 6, the vent grill 173 has a transversely elongated polyhedral shape. The vent grill 173 includes a suction passage 174, a first discharge passage 175, and a second discharge passage 176. The suction passage 174 is formed in the vent grill 173 and corresponds to the inlet portion 121 of the cavity assembly 100. The first and second discharge passages 175 and 176 are formed in the vent grill 173 and correspond to the first and second outlets 123 and 124 of the cavity assembly 100. That is, the suction passage 174 and the first discharge passage 175 are formed in both sides of the vent grill 173, and the second discharge passage 176 is formed in a center portion of the vent grill 173 between the suction passage 174 and the first discharge passage 175.

When the vent grill 173 is installed on the front portion of the cavity assembly 100, the terminal housing is disposed in the first discharge passage 175.

A pair of compartment ribs 177 is disposed in the vent grill 173 to define the suction passage 174 and the first and second discharge passages 175 and 176. That is, the suction passage 174 and the first and second discharge passages 175 and 176 are defined by inner surfaces of the vent grill 173 and both sides of the compartment ribs 177.

The suction passage 174 guides air to the inlet portion 121 of the cavity assembly 100. The vent grill 173 includes first and second suction grills 174A and 174B and a suction opening 174C. The first suction grill 174A is disposed on a top portion of the suction passage 174, and the second suction grill 174B is disposed on a side portion of the suction passage 174. The suction opening 174C is disposed on a rear portion of the suction passage 174. The first suction grill 174A is disposed at a right top side of the vent grill 173, and the second suction grill 174B is disposed at a right lateral side of the vent grill 173 close to the first suction grill 174A. The suction opening 174C is disposed at a right rear side of the vent grill 173 close to the second suction grill 174B. Air used to cool the door 200 or outside air is introduced into the suction passage 174 through the first and second suction grills 174A and 174B. The suction opening 174C communicates with the inlet portion 121 of the cavity assembly 100 such that air can flow from the suction passage 174 to the cavity assembly 100 through the suction opening 174C and the inlet portion 121.

The second discharge passages 175 and 176 are configured to guide air and fumes discharged from the cavity assembly 100 through the second outlets 123 and 124. The front side of the vent grill 173 is sloped in an upwardly extended shape such that air and fumes can be smoothly guided upward from the cavity assembly 100 by the second discharge passages 175 and 176. The vent grill 173 includes a first discharge hole 175A at a top surface of the first discharge passage 175, and a first discharge opening 175B at a rear surface of the first discharge passage 175. The first discharge hole 175A is disposed at a left top surface of the vent grill 173, and the first discharge opening 175B is disposed at a left rear surface of the vent grill 173 corresponding to the first discharge hole 175A. Air guided along the first discharge passage 175 is discharged through the first discharge hole 175A. The first discharge opening 175B communicates with the first outlet 123 of the cavity assembly 100 so that air can flow from the cavity assembly 100 to the first discharge passage 175 through the first outlet 123 and the first discharge opening 175B.

The vent grill 173 further includes second discharge holes 176A at a top surface of the second discharge passage 176, and second discharge openings 176B at a rear surface of the second discharge passage 176. The second discharge holes 176A are disposed at a top center portion of the vent grill 173 between the second suction grill 174B and the first discharge hole 175A. The second discharge openings 176B corresponding to the second discharge holes 176A are disposed at a rear center portion of the vent grill 173 between the first suction grill 174A and the first discharge opening 175B. Smoke and fumes, which are discharged from the cavity assembly 100 and guided along the second discharge passage 176, are discharged through the second discharge holes 176A. In the current embodiment, a pair of second discharge holes 176A is provided. The second discharge openings 176B communicate with the second outlet 124 such that smoke and fumes discharged from the cavity assembly 100 can be guided to the second discharge passage 176 through the second outlet 124 and the second discharge openings 176B.

A pair of fixing ribs 178 is disposed on a rear edge portion of the top surface of the vent grill 173. The fixing ribs 178 protrude backward from the rear edge portion of the vent grill 173 by a predetermined length. The fixing ribs 178 include penetration holes 178A. When attaching the vent grill 173 to the cavity assembly 100, screws are fixed to the front side of the cavity assembly 100 through the penetration holes 178A.

A lead wire opening 179 is formed in a left side of the vent grill 173 close to the first discharge passage 175. Referring to FIG. 7, a lead wire (W) is connected to the door 200 through the lead wire opening 179 to connect the display unit 260 of the door 200 to the terminal coupled to the terminal housing. The lead wire opening 179 can be formed to a predetermined depth by cutting out a left portion of the vent grill 173.

A lead wire cap 181 is detachably attached to the first discharge passage 175. The lead wire cap 181 separates the lead wire (W) from a portion of the first discharge passage 175 where air discharged from the cavity assembly 100 flows. In detail, air discharged from the cavity assembly 100 to the first discharge passage 175 flows in the lead wire cap 181, and the lead wire (W) is disposed in a wire accommodation gap 182 defined between the first discharge passage 175 and the lead wire cap 181.

The lead wire cap 181 has a polyhedral shape with opened top and rear sides. When the lead wire cap 181 is attached to the first discharge passage 175, front and lateral surfaces of the lead wire cap 181 are spaced a predetermined distance from front and lateral surfaces of the first discharge passage 175 (i.e., from inner surfaces of the vent grill 173 and the compartment ribs 177). The lead wire cap 181 can be detachably attached to the first discharge passage 175 by inserting the lead wire cap 181 into the first discharge passage 175 through the first discharge hole 175A. The lead wire cap 181 includes fixing tabs 183 and a rib grip 184 at a front upper portion. The fixing tabs 183 protrude forward from the front upper portion of the lead wire cap 181, and the rib grip 184 extends upward from the front upper portion of the lead wire cap 181. When the lead wire cap 181 is inserted into the first discharge passage 175, the fixing tabs 183 are hooked by a top portion of the vent grill 173 at the first discharge hole 175A so that the lead wire cap 181 can be securely held in the first discharge passage 175. The lead wire cap 181 can be detached from the first discharge passage 175 after moving the fixing tabs 183 away from the top portion of the vent grill 173 using the rib grip 184.

The door 200 for opening and closing the cooking chamber 111 is rotatably attached to the cavity assembly 100 in a manner such that the door 200 can be rotated up and down on its upper edge portion. Referring to FIG. 8, the door 200 includes a door panel 210, a doorframe 220, a choke cover 230, a front member such as a front cover 240 and a front glass 250, the display unit 260, and a door handle 270.

The door panel 210 has a rectangular shape and is a base structure of the door 200. The door panel 210 includes a see-through opening 211. A user can see the inside cooking chamber 111 through the see-through opening 211 without having to open the door 200. The see-through opening 211 can be formed by cutting a center portion of the door panel 210 into a rectangular shape.

A display opening 213 is formed in the door panel 210 under the see-through opening 211. The display unit 260 is exposed through the display opening 213. The display opening 213 can be formed by cutting a portion of the door panel 210 located under the see-through opening 211 into a rectangular shape.

An interference preventing portion 215 is formed on a top end of the door panel 210. The interference preventing portion 215 is formed to prevent interference between the door 200 and the vent grill 173 when the door 200 is rotated up or down on its upper edge portion to open or close the cooking chamber 111. The interference preventing portion 215 can be formed by cutting a top end portion of the door panel 210 into a shape corresponding to the vent grill 173.

Inlet holes 217 and outlet holes 219 are formed in the topside of the door panel 210. The inlet holes 217 allow inflow of outside air to a door cooling passage 201 (refer to FIG. 9). The outlet holes 219 allows outflow of air from the door cooling passage 201. The inlet holes 217 are disposed at one side of the topside of the door panel 210 such that the inlet holes 217 is close to the first discharge hole 175A of the vent grill 173 when the door 200 is attached to the cavity assembly 100. The outlet holes 219 are disposed at a side of the interference preventing portion 215 away from the inlet holes 217. That is, the outlet holes 219 are disposed at the other side of the topside of the door panel 210 away from the inlet holes 217.

The doorframe 220 is disposed at a rear side of the door panel 210. A plurality of chokes 221 disposed on edge portions of the doorframe 220. The chokes 221 prevent leakage of microwaves from the cooking chamber 111. An opening portion 223 corresponding to the see-through opening 211 of the door panel 210 is formed in a center portion of the doorframe 220.

An interference preventing portion 225 is formed on a top end of the doorframe 220. The interference preventing portion 225 can be formed by cutting a top end portion of the doorframe 220 into a shape corresponding to the interference preventing portion 215 (i.e., corresponding to the vent grill 173).

A pair of hinge flanges 227 is disposed at each lateral side of the doorframe 220. The hinge flanges 227 are spaced a predetermined distance from the lateral side of the 220. The hinge pin 228 is horizontally disposed between the hinge flanges 227. Practically, the door 200 rotates on the hinge pin 228. When the door 200 is attached to the cavity assembly 100, the hinge pin 228 is inserted in the hinge grooves 134 and the hinge pin openings 138 of the door support bracket 131.

Spring fixing pins 229 are disposed on both sides of the doorframe 220 under the hinge flanges 227. The spring fixing pins 229 are used to fix the gas springs 300 (refer to FIG. 300). When assembled, the spring fixing pins 229 are inserted into side portions of spring accommodation portions 235 (described later) and disposed in the spring accommodation portions 235.

The choke cover 230 is disposed at a rear side of the doorframe 220. The choke cover 230 is disposed at an opposite side to the door panel 210 with respect to the doorframe 220. The choke cover 230 forms a rear outer surface of the door 200. The choke cover 230 includes a see-through opening 231 corresponding to the see-through opening 211 of the door panel 210 and the opening portion 223 of the doorframe 220. The see-through opening 231 can be formed by cutting out a center portion of the choke cover 230 into a rectangular shape.

An interference preventing portion 233 is formed on a top end of the choke cover 230. Like the interference preventing portion 215 of the door panel 210 and the interference preventing portion 225 of the doorframe 220, the interference preventing portion 233 can be formed by cutting a top end portion of the choke cover 230 into a shape corresponding to the vent grill 173.

The spring accommodation portions 235 are disposed on both sides of the choke cover 230. When the door 200 closes the cooking chamber 111, the gas springs 300 is disposed in the spring accommodation portions 235. Each of the spring accommodation portions 235 has a vertically elongated hexahedron shape. The spring accommodation portions 235 can be formed by recessing side portions of the choke cover 230 toward the doorframe 220.

Latch holes 237 corresponding to the latch slots 145 of the cavity assembly 100 are formed in both sides of the choke cover 230. When assembled, the latch protrusions 281 are inserted into the latch holes 237 and protruded backward. The latch holes 237 can be formed by cutting out side portions of the choke cover 230 into a shape corresponding to the latch protrusions 281. The latch holes 237 have a predetermined width corresponding to the width of the latch protrusions 281.

The front cover 240 is disposed at a front side of the door panel 210. Practically, the front cover 240 forms the front exterior of the door 200. The front cover 240 can be formed of a metal. In the current embodiment, the front cover 240 is approximately U-shaped with an opened top to enclose the see-through opening 211 and the display opening 213 of the door panel 210.

The front glass 250 forms the front exterior of the door 200 together with the front cover 240. For this, the front glass 250 is disposed at a position corresponding to the see-through opening 211 and the interference preventing portion 215 of the door panel 210. That is, the front glass 250 covers the see-through opening 211 and the interference preventing portion 215 of the door panel 210.

The display unit 260 is used to receive various operational commands and display various information about operation of the microwave oven. The display unit 260 is surrounded by the door cooling passage 201. The display unit 260 includes a main printed circuit board substrate 261, a backlight printed circuit board substrate 263, a reflector 265, a display cover 267, and a display glass 269.

When assembled, the main printed circuit board substrate 261 is disposed in a portion of the door 200 corresponding to the display opening 213 of the door panel 210. That is, the main printed circuit board substrate 261 is disposed between the door panel 210 and the doorframe 220. A display device 262 is disposed on a front surface of the main printed circuit board substrate 261. The display device 262 is exposed through the display opening 213 of the door panel 210 and displays various information about operation of the microwave oven. A vacuum fluorescent display (VFD), which uses radiation of a fluorescent material caused by a low-speed electron ray, can be used as the display device 262. The display device 262 is fixed to the main printed circuit board substrate 261 using a fixing bracket 262A. The main printed circuit board substrate 261 includes a plurality of electric components (not shown) for operation of the display unit 260. The lead wire (W) (refer to FIG. 9) is connected to the main printed circuit board substrate 261 through the lead wire opening 179 of the vent grill 173.

The backlight printed circuit board substrate 263 is disposed in the door 200 at a front side of the main printed circuit board substrate 261. That is, the backlight printed circuit board substrate 263 is disposed between the door panel 210 and the main printed circuit board substrate 261. A plurality of light emitting diodes (not shown) is disposed on a front side of the backlight printed circuit board substrate 263. The light emitting diodes emit light to illuminate buttons 266 (described later). The backlight printed circuit board substrate 263 includes a display opening for receiving the display device 262.

The reflector 265 is disposed in the door 200 between the door panel 210 and the backlight printed circuit board substrate 263. The reflector 265 reflects light emitted from the light emitting diodes of the backlight printed circuit board substrate 263. The buttons 266 are disposed on a front side of the reflector 265 that is exposed through the display opening 213 of the door panel 210. The buttons 266 can be touch-screen buttons for receiving operational commands. Like the backlight printed circuit board substrate 263, the reflector 265 includes a display opening.

The display cover 267 disposed at a front side of the reflector 265. Characters or symbols are printed on the display cover 267 for indicating functions of the buttons 266. A film coated with a conductive indium tin oxide (ITO) compound can be used as the display cover 267 to allow the buttons 266 to operate as touch-screen buttons for receiving operational commands. Like the backlight printed circuit board substrate 263 and the reflector 265, the display cover 267 includes a display opening.

The display glass 269 is disposed at a front side of the display cover 267 and forms a portion of the front exterior of the door 200. For this, the display glass 269 has a rectangular shape corresponding to the shape of the display opening 213 of the door panel 210 and is disposed on the display opening 213 of the door panel 210.

The display unit 260 is assembled as a single module and is fixed to the rear surface of the door panel 210. In other words, the main printed circuit board substrate 261, the backlight printed circuit board substrate 263, the reflector 265, the display cover 267, and the display glass 269 are assembled into the display unit 260 independently of other components of the door 200, and then the display unit 260 is fixed to the rear surface of the door panel 210.

The door handle 270 is used when a user rotates the door 200. The door handle 270 can have a hollow rod shape and be transversely disposed on the front cover 240. Both ends of the door handle 270 are fixed to the door panel 210 through the front cover 240.

The pair of latch protrusions 281 is disposed between the door panel 210 and the choke cover 230. The latch protrusions 281 are inserted into the latch holes 237 and protrude backward from the door 200. When the door 200 is rotated down to close the cooking chamber 111, the latch protrusions 281 lock the door 200 in the closed position. The latch protrusions 281 are horizontally arranged. Each of the latch protrusions 281 includes a latch hole for selectively receiving the actuation lever 147 of the latch board 146.

The door cooling passage 201 is formed in the door 200. The door cooling passage 201 is formed to cool the door 200, particularly, the display unit 260. Substantially, the door cooling passage 201 is formed by the door panel 210 and the choke cover 230. The door cooling passage 201 is formed in the door 200 into an approximate U-shape with opened tops. The opened tops of the door cooling passage 201 are connected to the inlet holes 217 and the outlet holes 219 of the door panel 210.

A handle cooling passage 271 (refer to FIG. 9) is formed in the door handle 270. The handle cooling passage 271 is formed to cool the door handle 270. Both ends of the handle cooling passage 271 are connected to the door cooling passage 201. Thus, some air flows from the door cooling passage 201 to the handle cooling passage 271.

The pair of gas springs 300 support the door 200 with respect to the cavity assembly 100 when the cooking chamber 111 is opened. When the door 200 is at a position between fully closed and opened positions, the gas springs 300 apply a torque to the door 200 for closing or further opening the cooking chamber 111 based on a reference position between the fully closed and opened positions of the door 200. For example, the reference position can be a middle position between the fully closed and opened positions of the door 200 (refer to FIG. 15). In this case, when the door 200 is at a position above the reference position, the gas springs 300 apply a torque to the door 200 to rotate the door 200 up to the fully opened position. When the door is at a position below the reference position, the gas springs 300 apply a torque to the door 200 to rotate the door 200 down to the fully closed position.

Referring to FIG. 1, each of the gas springs 300 includes a cylinder 310 in which gas is filled, and a piston rod 320 inserted into the cylinder 310. The piston rod 320 is linearly movable by pressure of the gas filled in the cylinder 310. One end of the piston rod 320 is inserted into one end of the cylinder 310. The other end of the piston rod 320 is rotatably supported on the rear surface of the door panel 210, and the other end of the cylinder 310 is rotatably supported on the front surface of the cavity assembly 100. In detail, the other end of the cylinder 310 is rotatably supported on the fixing protrusion 143 of the cavity assembly 100, and the other end of the piston rod 320 is rotatably supported on the spring fixing pin 229 of the door panel 210.

When the door 200 is closed (i.e., when the cooking chamber 111 is closed), the gas springs 300 are disposed in the spring accommodation portions 235 of the door 200. When the door 200 is fully rotated down to close the cooking chamber 111, the front surface of the cavity assembly 100 and the rear surface of the door 200 are not spaced apart from each other owing to the gas springs 300.

An exemplary operation of the ventilation hooded microwave oven will now be described in detail with reference to the accompanying drawings according to the first embodiment.

First, procedures for installing the door 200 to the cavity assembly 100 will now be described according to the first embodiment.

Figure 10:
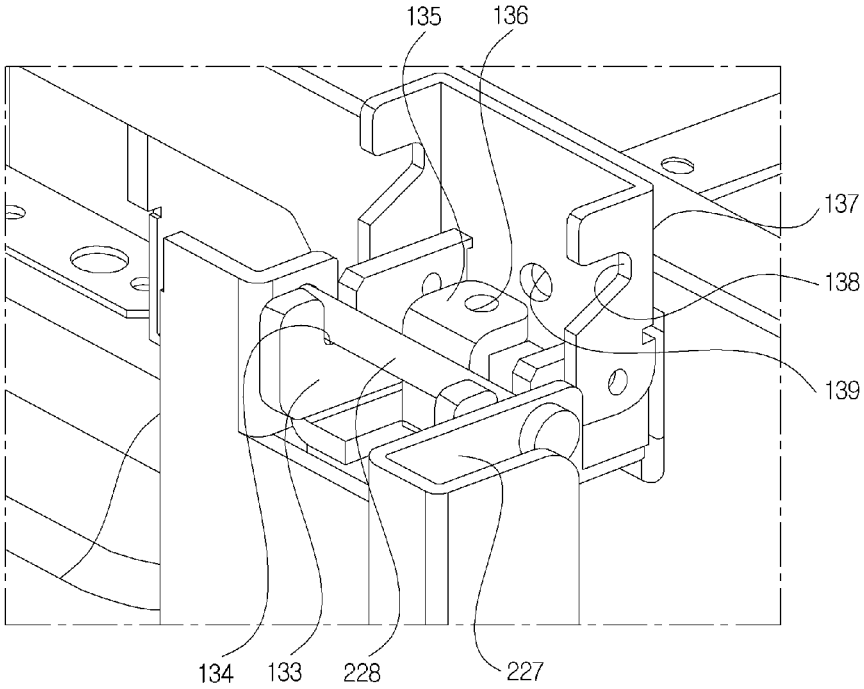
FIGS. 10 to 12 are partial perspective views for explaining procedures for attaching the door to a cavity assembly of the ventilation hooded microwave oven according to the first embodiment.
Figure 11:
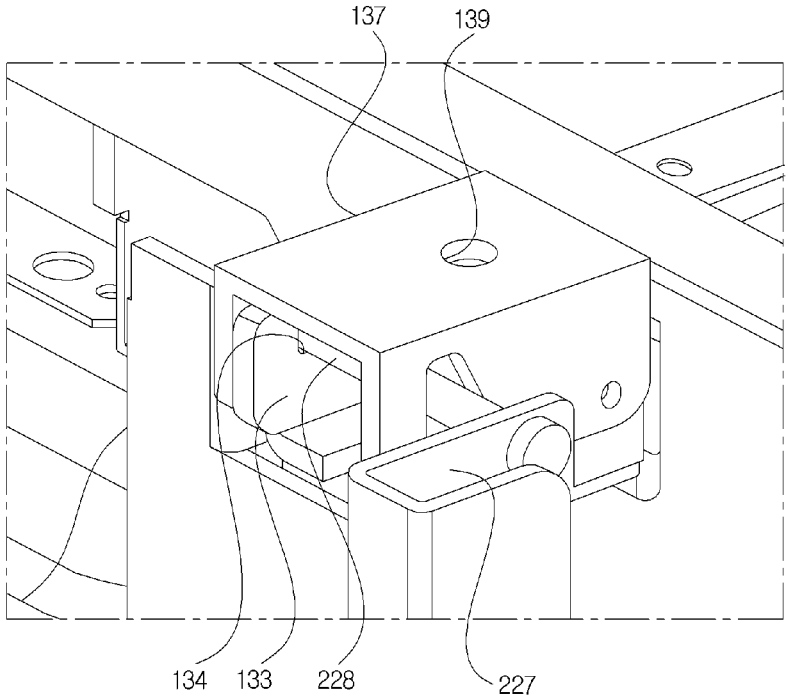
Figure 12:
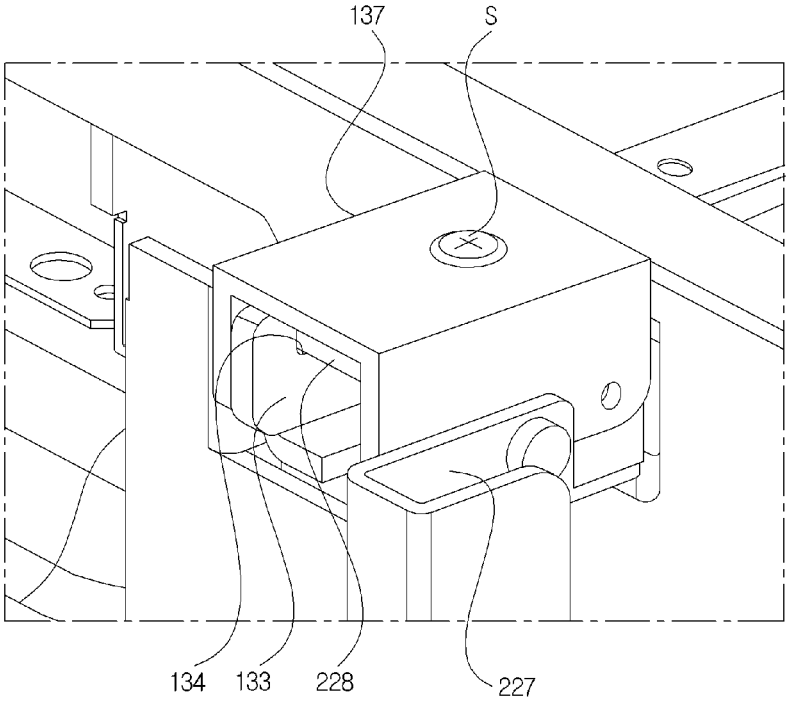

FIGS. 10 to 12 are partial perspective views for explaining procedures for installing the door 200 to the cavity assembly 100 according to the first embodiment.

For example, the cavity assembly 100 is installed in furniture (not shown) above a cooker (not shown). In this state, as shown in FIG. 10, the door 200 is moved toward the cavity assembly 100 in a manner such that the hinge pin 228 can be moved down into the hinge grooves 134. Here, the coupling hole 136 of the hinge bracket 133 is exposed to the outside of the furniture.

Thereafter, as shown in FIG. 11, the hinge cover 137 is rotated down to securely hold the hinge pin 228 in the hinge grooves 134. Here, when the hinge cover 137 is rotated down, the hinge pin 228 is inserted into the hinge pin openings 138 from bottoms to tops of the hinge pin openings 138. Then, the penetration hole 139 of the hinge cover 137 is vertically aligned with the coupling hole 136 of the hinge bracket 133.

In this way, detachment of the hinge pin 228 can be prevented using the hinge cover 137. Thereafter, as shown in FIG. 12, a screw (S) is fixed to the coupling hole 136 of the hinge bracket 133 through the penetration hole 139 of the hinge cover 137. By this, the hinge cover 137 can be securely fixed, and thus detachment of the hinge pin 228 can be reliably prevented.

As explained above, the coupling hole 136 of the hinge bracket 133, and the penetration hole 139 of the hinge cover 137 are exposed to the outside of the furniture. Therefore, the door 200 can be attached to the cavity assembly 100 without having to separate the cavity assembly 100 from the furniture.

Next, it will be described how the door 200 of the ventilation hooded microwave oven is opened according to the first embodiment.

FIGS. 13 to 17 are views for explaining how the door 200 of the ventilation hooded microwave oven is opened according to the first embodiment.

Figure 13:
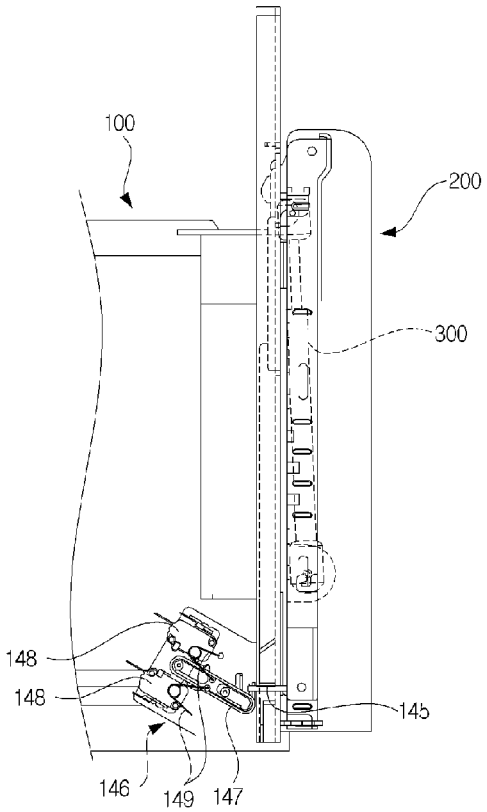
FIGS. 13 to 17 are views for explaining how the door of the ventilation hooded microwave oven is opened according to the first embodiment.

Referring to FIG. 13, when the door 200 is closed (i.e., when the cooking chamber 111 is closed), the rear surface of the door 200 is in contact with the front surface of the cavity assembly 100. In this state, the latch protrusion 281 is in the latch slot 145, and the actuation lever 147 is accommodated in the latch protrusion 281. Thus, the latch protrusion 281 is not freely released from the latch slot 145.

Meanwhile, when the latch protrusion 281 is inserted into the latch slot 145, the actuation lever 147 is pushed by the latch protrusion 281 so that the latch switches 148 can be turned on. Then, an operational command can be input using the buttons 266 of the display unit 260 to operate the microwave oven according to the input operational command for cooking food in the cooking chamber 111.

Figure 14:
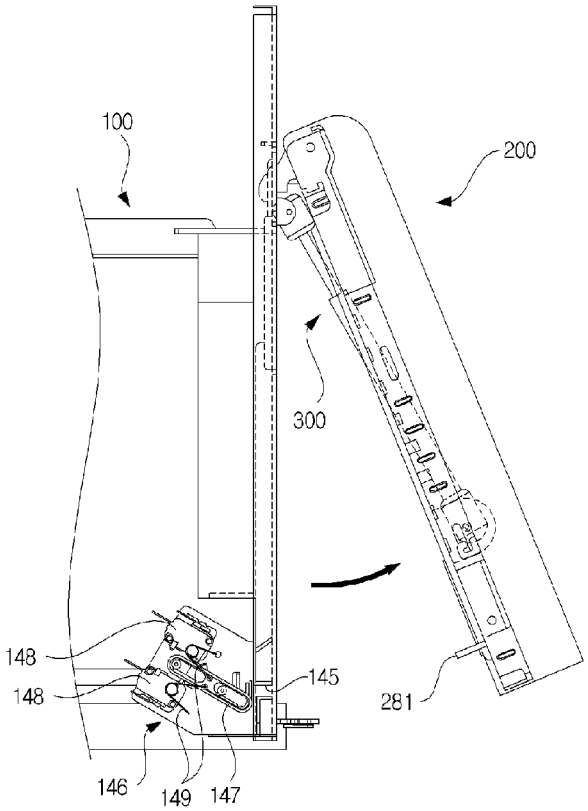

After the food is cooked in the cooking chamber 111, the cooking chamber 111 can be opened by rotating up the door 200. For example, a user can pull the door handle 270 in an upwardly curved direction to rotate up a lower end of the door 200 about the hinge pins 228 so as to open the cooking chamber 111 as shown in FIG. 14. At this time, the latch protrusions 281 are released from the latch slots 145. After the latch protrusions 281 are released from the latch slots 145, the actuation lever 147 moves back to its initial position by a force applied to the actuation lever 147 from the torsion springs 149.

Until the door 200 is rotated up to a predetermined position (e.g., the middle position between fully closed and opened positions), the gas springs 300 apply a reverse torque to the door 200 to rotate down the door 200 back to the fully closed position. Thus, unless the user pulls the door handle 270 in an upwardly curved direction to the predetermined position, the lower end of the door 200 may rotate down about the hinge pins 228 to the closed position to close the cooking chamber 111.

Figure 15:
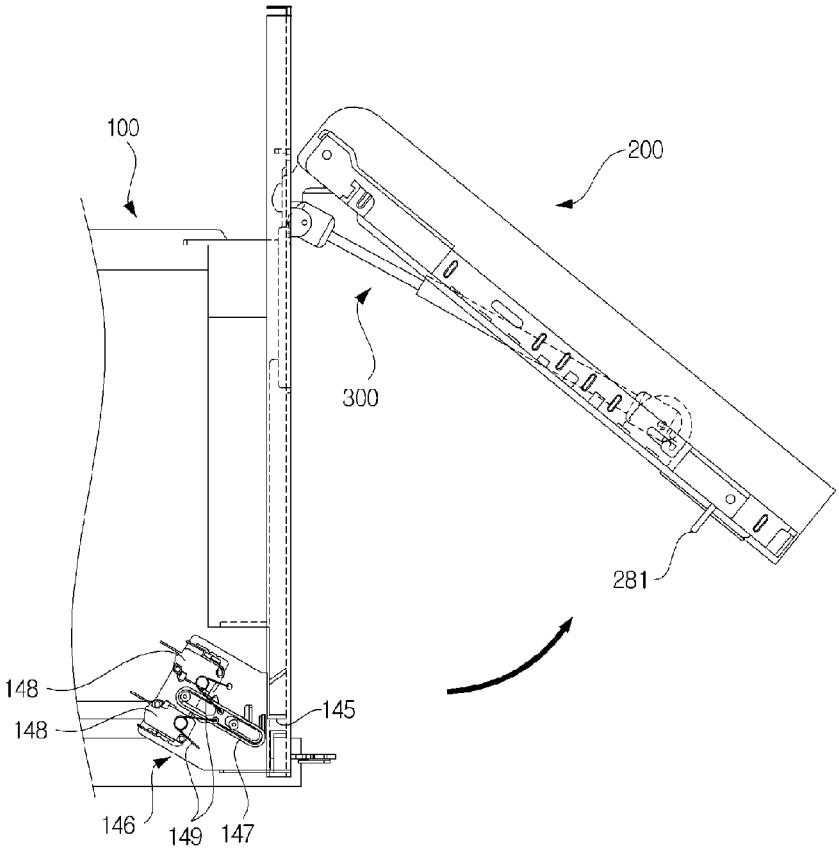

However, if the user pulls the door handle 270 above the predetermined position, the lower end of the door 200 can be rotated upward about the hinge pins 228 to the fully closed position. Referring to FIG. 15, the door 200 is positioned above the middle position between fully closed and opened positions. In this state, the gas springs 300 apply a torque to the door 200 to rotate the lower end of the door 200 upward about the hinge pins 228 so as to fully open the cooking chamber 111.

Figure 16:
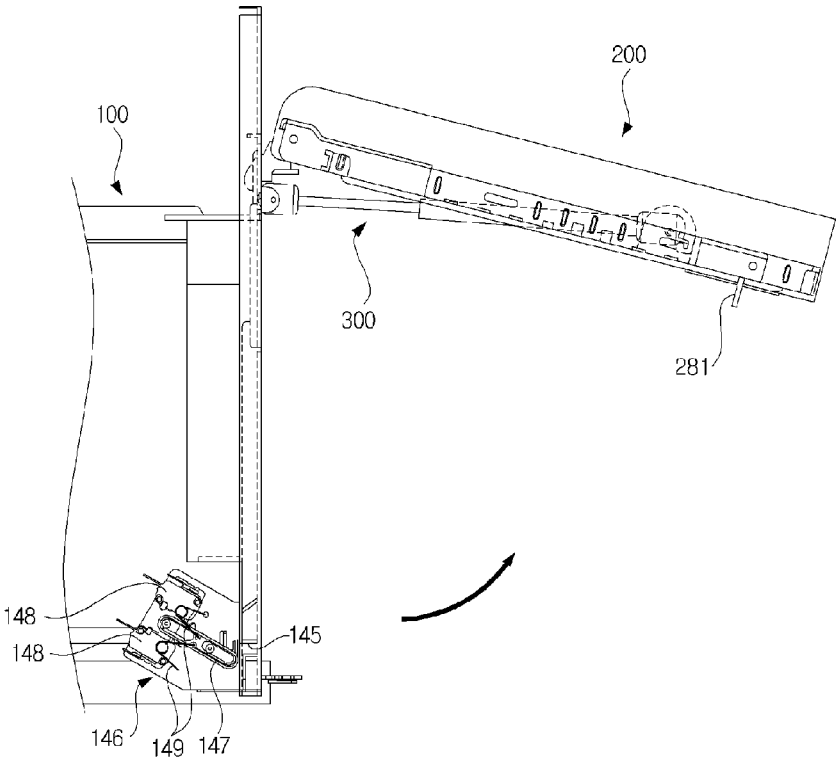
Figure 17:
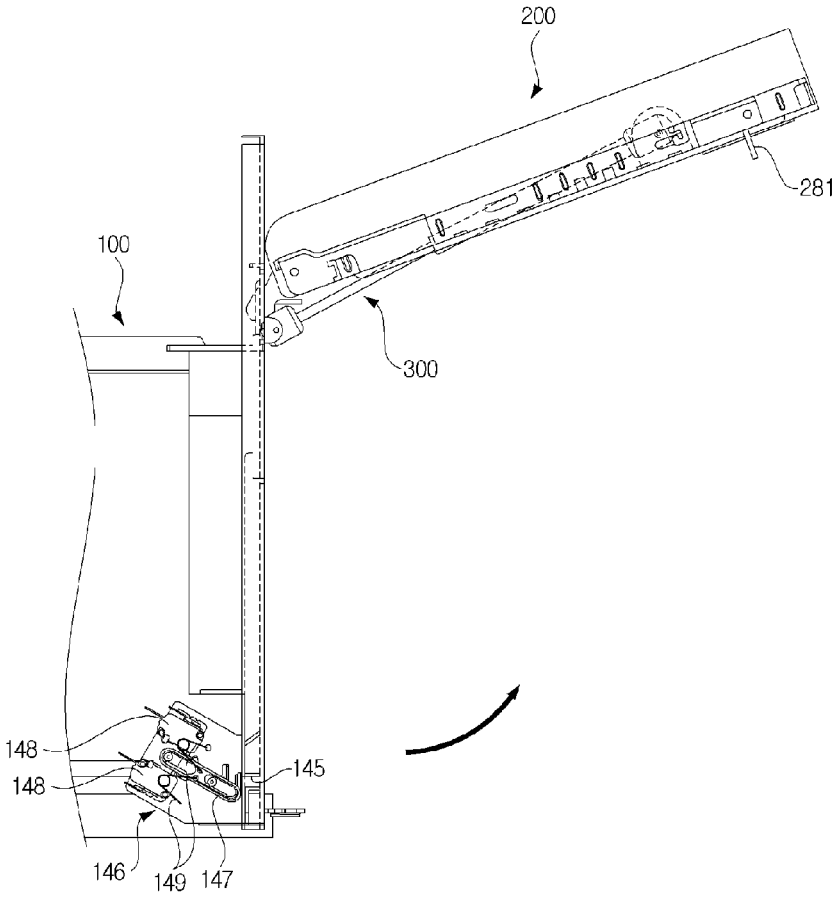

Therefore, as shown in FIG. 16, although the user does not pull the door handle 270 after the door 200 is positioned above the middle position, the door 200 can be rotated upward to open the cooking chamber 111. Referring to FIG. 17, the door 200 is rotated upward to the fully opened position. That is, the cooking chamber 111 is fully opened.

After the cooking chamber 111 is opened in this way, cooked food can be taken out of the cooking chamber 111, or non-cooked food can be placed into the cooking chamber 111. Here, since the gas springs 300 apply a torque to the opened door 200 in an upward direction, the door 200 is not freely moved from the opened position so that loading and unloading of food into and from the cooking chamber 111 can be conveniently carried out without interruption by the door 200.

After loading food into the cooking chamber 111 or unloading food from the cooking chamber 111, the user can close the cooking chamber 111 by pushing the door 200 downwardly to the closed position. The closing of the cooking chamber 111 can be carried out in a reverse order as compared with the opening of the cooking chamber 111. That is, when a user pushes the door handle 270 forward and downward, the door 200 starts to rotate down about the hinge pins 228. After the door 200 is rotated down below the middle position between the fully closed and opened position (refer to FIG. 15), the gas springs 300 apply a torque to the door 200 to rotate down the lower end of the door 200 about the upper end of the door 200. Therefore, although the user does not push the door handle 270 after the door 200 is positioned below the middle position, the lower end of the door 200 can be rotated down about the upper end of the door 200 to close the cooking chamber 111.

Next, exemplary airflows in the ventilation hooded microwave oven will be described according to the first embodiment.

Figure 18:
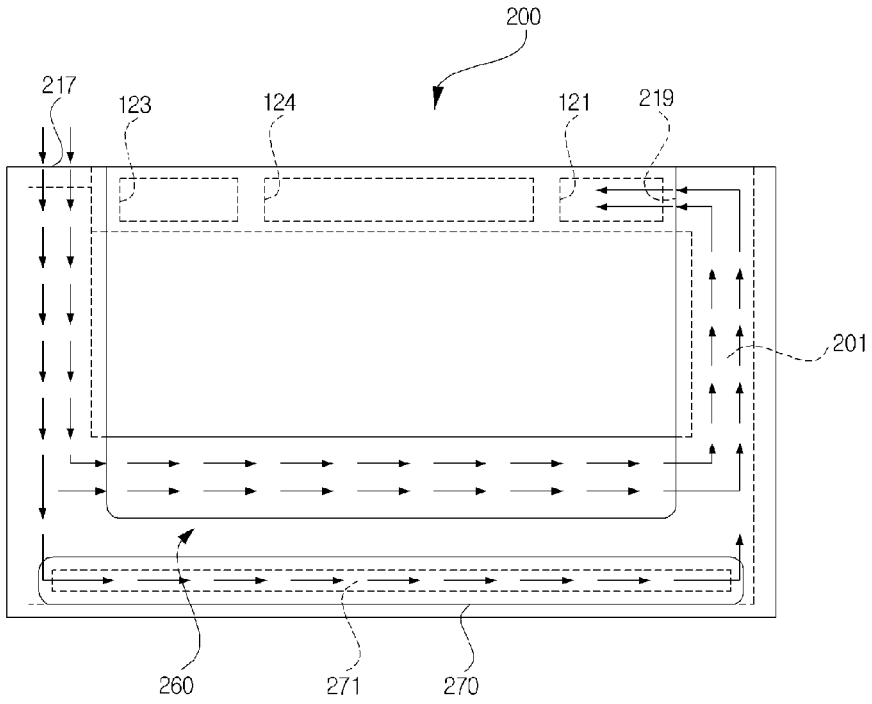
FIGS. 18 to 20 are views illustrating exemplary flows of air in the ventilation hooded microwave oven according to the first embodiment.
Figure 19:
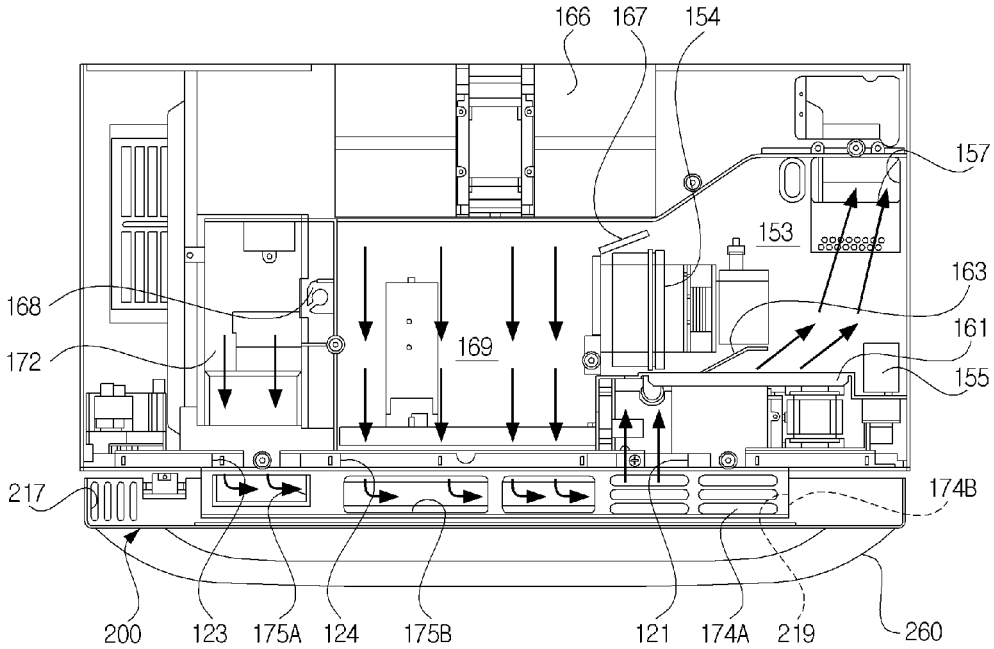
Figure 20:
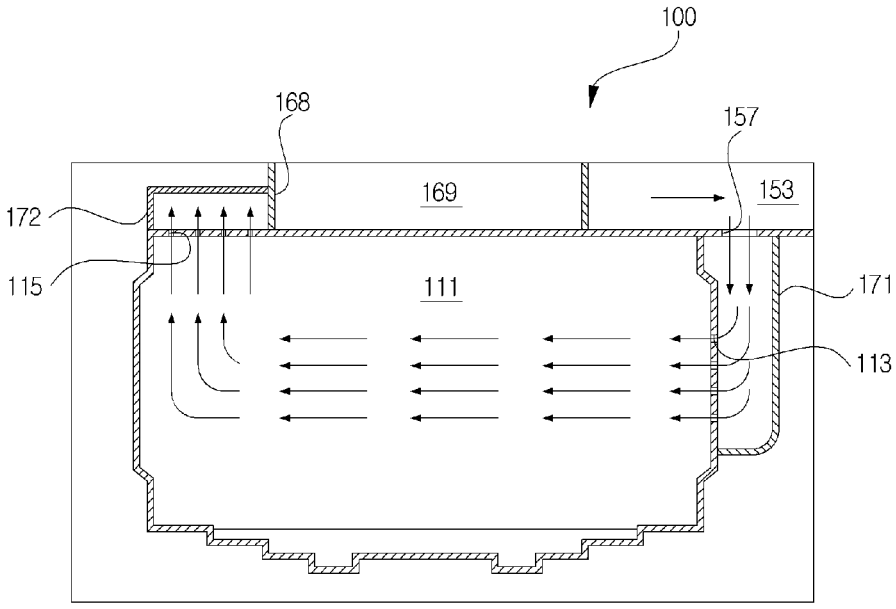

FIGS. 18 to 20 are views illustrating exemplary airflows in the ventilation hooded microwave oven according to the first embodiment.

When the microwave oven start to operate, the cooling fan assembly 159 sucks air into the door cooling passage 201 through the inlet holes 217 of the door 200 as shown in FIG. 18. While flowing along the door cooling passage 201, the air cools the door 200, particularly, the display unit 260.

Some of the air flows from the door cooling passage 201 to the handle cooling passage 271 to cool the door handle 270. Thereafter, the air flows back to the door cooling passage 201. After the air is used to cools the door 200 and the door handle 270, the air is discharged from the door cooling passage 201 through the outlet holes 219 of the door 200.

Referring to FIG. 19, the air discharged from the door cooling passage 201 through the outlet holes 219 is introduced into the suction passage 174 of the vent grill 173 through the first suction grill 174A. Then, the air flows from the suction passage 174 to the cavity assembly 100 through the suction opening 174C of the vent grill 173 and the inlet portion 121 of the cavity assembly 100. As well as the air used to cool the door 200 and introduced into the cavity assembly 100 through first suction grill 174A, other outside air can be introduced into the cavity assembly 100 through the second suction grill 174B of the vent grill 173.

The air introduced into the cavity assembly 100 is directed to the electric component room 153 through the air supply opening 162 of the air bather 161 to cool electric components such as the magnetron 154 and the capacitor 155. Here, the guide 163 of the air barrier 161 guides the air to the electric components. Thereafter, the air is guided to the first air duct 171 through the opening 157.

The air guided to the first air duct 171 flows into the cooking chamber 111 through the inlet holes 113 of the cooking chamber 111 as shown in FIG. 20. Then, the air flows from the cooking chamber 111 to the second air duct 172 through the outlet holes 115. Here, while passing through the cooking chamber 111, the air absorbs moisture, gaseous fatty substances, and odors generated from food cooked in the cooking chamber 111. The air containing such substances is guided from the second air duct 172 to the first discharge passage 175 of the vent grill 173 through the first outlet 123 of the cavity assembly 100. Then, the air is discharged from the first discharge passage 175 through the first discharge hole 175A. Here, the air discharged from the cavity assembly 100 to the first discharge passage 175 is guided upward through the first discharge hole 175A.

Meanwhile, as shown in FIG. 19, when the vent fan assembly 166 operates, smoke and fumes generated from food cooked on a cooker disposed under the microwave is introduced into the cavity assembly 100 through the smoke inlet portion 151 (refer to FIG. 1). Then, the smoke and fumes flow along the vent passage 169 and are guided to the second discharge passage 176 of the vent grill 173 through the second outlet 124 of the cavity assembly 100. The smoke and fumes are discharged upward from the second discharge passage 176 through the second discharge holes 176A of the vent grill 173.

When the capacitor 155 is damaged or broken, the capacitor 155 can be replaced with a new one without having to separate the cavity assembly 100 from the furniture. In detail, the service opening 127 (i.e., the opening/closing bracket 129) can be exposed by rotating the door 200 upward on the hinge pins 228 to open the cooking chamber 111. Thereafter, the opening/closing bracket 129 can be separated from the cavity assembly 100 to open the service opening 127. Then, the capacitor 155 installed in the component installation hole 165 of the air barrier 161 can be detached through the service opening 127, and a new capacitor 155 can be installed in the component installation hole 165. After replacing the capacitor 155, the opening/closing bracket 129 is attached to the front of the cavity assembly 100 to close the service opening 127. In this way, replacing of the capacitor 155 can be completed.

Although embodiments have been described with reference to a number of illustrative embodiments thereof, it should be understood that numerous other modifications and embodiments can be devised by those skilled in the art that will fall within the scope of the disclosure, the drawings and the appended claims.

For example, although the spring accommodation portions are formed in the rear surface of the door in the above-described embodiment, the spring accommodation portions can be formed in the front surface of the cavity assembly in other embodiments. Furthermore, a damping member can be disposed at a lower portion of the front surface of the cavity assembly or a lower portion of the rear surface of the door in order to reduce shocks and noises when the door is rotated to close or open the cooking chamber of the cavity assembly.

MODE FOR THE INVENTION

A ventilation hooded microwave oven will now be described in detail with reference to the accompanying drawings according to other embodiments.

Figure 21:
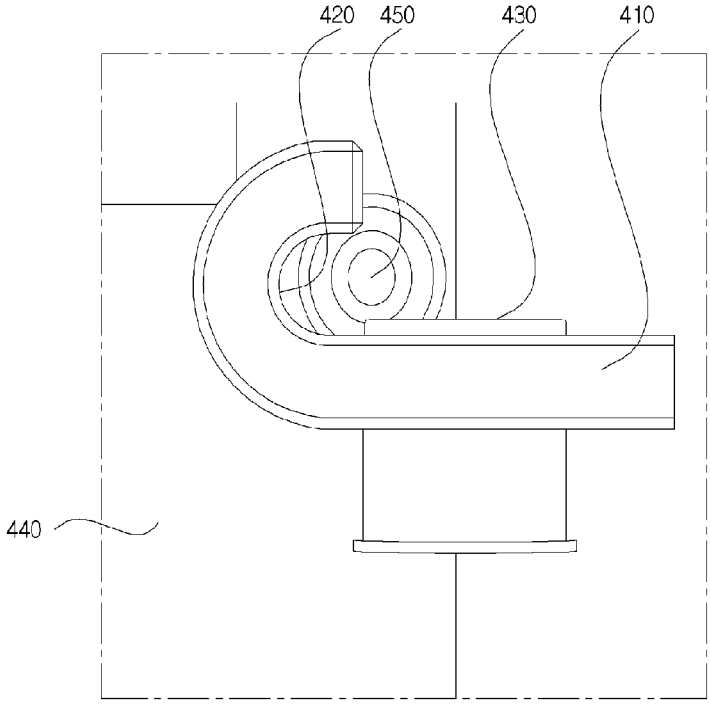
FIG. 21 is a side view illustrating a door support device for supporting a door of a ventilation hooded microwave oven according to a second embodiment.
Figure 22:
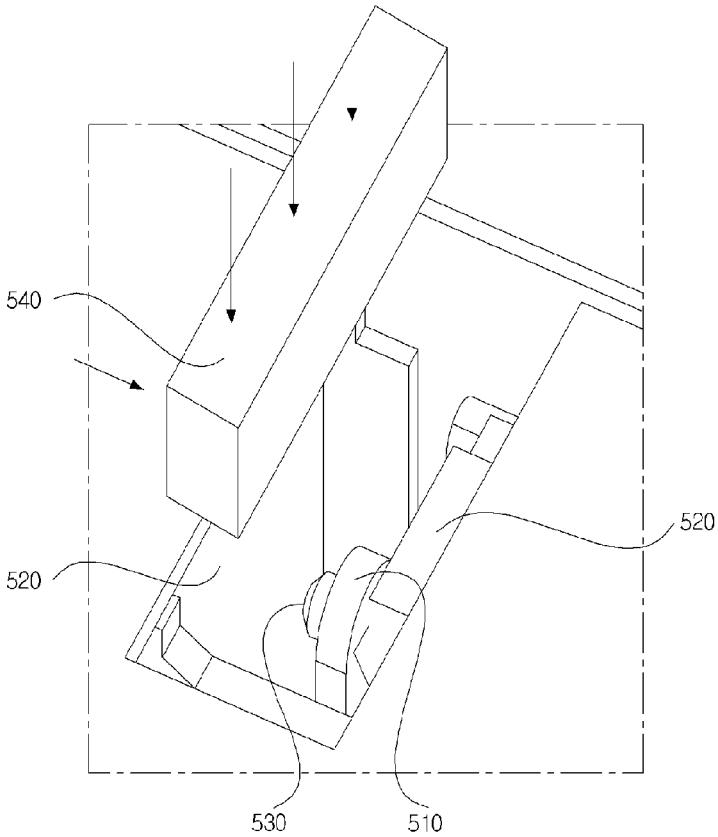
FIG. 22 is a partial perspective view illustrating a door support device of a ventilation hooded microwave oven according to a third embodiment.

FIG. 21 is a side view illustrating a door support device of a ventilation hooded microwave oven according to a second embodiment, and FIG. 22 is a partial perspective view illustrating a door support device of a ventilation hooded microwave oven according to a third embodiment.

In the embodiment shown in FIG. 21, hinge brackets 410 (one shown in FIG. 21) are disposed at both sides of a front upper portion of a cavity assembly (not shown) to support a door (not shown) with respect to the cavity assembly in a manner such that a lower end of the door can be rotated upward and downward about an upper end of the door. A hinge groove 420 is formed in a leading end of the hinge bracket 410. The hinge groove 420 is opened backwardly. Thus, the leading end of the hinge bracket 410 can be U-shaped.

Opening/closing members 430 (one shown in FIG. 21) are disposed at both sides of an upper end portion of the cavity assembly close to the hinge brackets 410. The opening/closing members 430 are vertically movable. The opening/closing member 430 selectively opens and closes the hinge groove 420. For this, the opening/closing member 430 has a side portion making contact with the hinge bracket 410 and is vertical movable to close and open the hinge groove 420 selectively. The opening/closing member 430 disposed at the upper end portion of the cavity assembly does not overlap the hinge groove 420.

Elastic members (not shown) are disposed at both sides of the upper end portion of the cavity assembly to apply an elastic force to the opening/closing members 430 to move the opening/closing members 430 upwardly. For example, coil springs can be vertically disposed as the elastic members. After the opening/closing member 430 is moved up to close the hinge groove 420, the opening/closing member 430 is not freely moved down owing to the elastic member, and thus the closed state of the hinge groove 420 can be reliably maintained.

A pair of hinge flanges 440 is disposed at each lateral side of an upper rear portion of the door. The hinge flanges 440 are spaced a predetermined distance from the lateral side of the upper rear portion of the door. The predetermined distance is at least greater than the sum of the thicknesses of the hinge bracket 410 and the opening/closing member 430.

The hinge flanges 440 protrude backward from the lateral side of the upper rear portion of the door, and a hinge pin 450 is horizontally disposed between the hinge flanges 440. The hinge pin 450 is disposed in the hinge groove 420 by inserting the hinge pin 450 into the hinge groove 420 from the back of the hinge groove 420. Practically, the hinge pin 450 is a rotation center of the door rotatably attached to the cavity assembly.

In the current embodiment, the door can be rotatably attached to the cavity assembly as follows. First, the door is moved toward the cavity assembly to place the hinge pin 450 above the opening/closing member 430. Next, the door is moved down to push the opening/closing member 430 with, the hinge pin 450.

Then, the opening/closing member 430 is moved down by the hinge pin 450, and the hinge pin 450 makes contact with the hinge bracket 410. In this state, the door is moved forward to insert the hinge pin 450 into the hinge groove 420. When the hinge pin 450 is inserted into the hinge groove 420, the hinge pin 450 departs from the opening/closing member 430 such that the opening/closing member 430 can be lifted by the resilience of the elastic member to close the hinge groove 420. Since the opening/closing member 430 closes the hinge groove 420, the hinge pin 450 inserted into the hinge groove 420 is not freely released from the hinge groove 420.

In the embodiment shown in FIG. 22, hinge brackets 510 are disposed at both sides of a front upper portion of a cavity assembly (not shown). The hinge brackets 510 protrude forward from both sides of the front upper portion of the cavity assembly. Each of the hinge brackets 510 includes a hinge hole (not shown).

A door (not shown) is attached to the cavity assembly in a manner such that a lower end of the door can be rotatable about an upper end of the door. A pair of hinge flanges 520 is disposed at each lateral side of a rear upper portion of the door. The hinge flanges 520 are spaced a predetermined distance from the lateral side of the rear upper portion of the door. The hinge flanges 520 protrude backward from the rear upper portion of the door.

A hinge pin 530 is disposed on one of the hinge flanges 520. The hinge pin 530 protrudes horizontally from one of the hinge flanges 520 toward the other of the hinge flanges 520. A leading end of the hinge pin 530 is spaced a predetermined distance from the other of the hinge flanges 520. When assembled, the hinge pin 530 is horizontally inserted in the hinge hole of the hinge bracket 510.

After inserting the hinge pin 530 into the hinge hole of the hinge bracket 510, a closing member 540 is inserted between the leading end of the hinge pin 530 and the other of the hinge flange 520. The closing member 540 prevents the hinge pin 530 from freely departing from the hinge hole of the hinge bracket 510.

A ventilation hooded microwave oven will now be described in detail with reference to the accompanying drawings according to a fourth embodiment.

Figure 23:
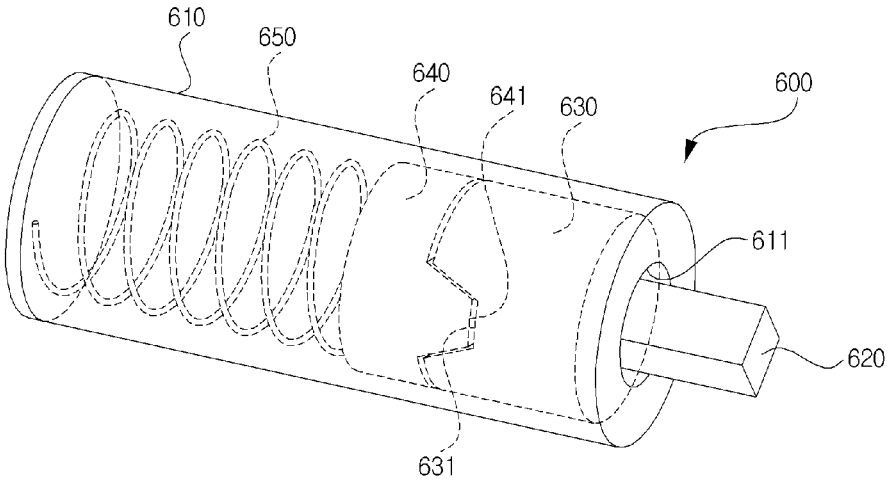
FIG. 23 is a perspective view illustrating a cam hinge of a ventilation hooded microwave oven according to a fourth embodiment.

FIG. 23 is a perspective view illustrating a cam hinge of a ventilation hooded microwave oven according to a fourth embodiment.

In the current embodiment, a cooking chamber (not shown) disposed in a cavity assembly (not shown) is closed and opened using a door (not shown), and a pair of cam hinges 600 (one shown in FIG. 23) is used to attach the door to the cavity assembly in a manner such that a lower end of the door can be rotated about an upper end of the door.

The cam hinges 600 apply a torque to the door in a direction for opening the door or closing the door according to the angular position of the door. In other words, the cam hinges 600 apply a torque to the door in different directions based on a reference angular position of the door. For example, when the door is positioned above the reference regular position, the cam hinges 600 apply a torque to the door in a predetermined direction to rotate up the lower end of the door about the upper end of the door so as to open the cooking chamber. When the door is positioned below the reference regular position, the cam hinges 600 apply a torque to the door in an opposite direction to rotate down the door for closing the cooking chamber.

For this, each of the cam hinges 600 includes a long cam housing 610, a hinge protrusion 620, a rotation cam 630, a movable cam 640, and an elastic member 650. One end portion of the hinge protrusion 620 is inserted in an end of the cam housing 610, and the other end portion of the hinge protrusion 620 protrudes from the end of the cam housing 610. The rotation cam 630 is disposed in the cam housing 610 and is rotatable on the hinge protrusion 620. The movable cam 640 is disposed in the cam housing 610 and is movable in a length direction of the cam housing 610. The elastic member 650 elastically supports the movable cam 640. The hinge protrusions 620 of the cam hinges 600 are oriented such that the hinge protrusions 620 protrude from the cam hinges 600 in opposite directions.

The cam housing 610 forms the exterior of the cam hinge 600. The cam housing 610 has a hollow cylindrical shape having a predetermined length. A hinge hole 611 is formed on the end of the cam housing 610 to receive the hinge protrusion 620.

The hinge protrusion 620 is inserted in the hinge hole 611. A portion of the hinge protrusion 620 protrudes outward from the cam housing 610, and the other portion of the hinge protrusion 620 is disposed in the cam housing 610. When assembled, the portion of the hinge protrusion 620 protruding from the cam housing 610 is inserted in a hinge hole (not shown) of the cavity assembly and functions as a rotation center of the door. When the door attached to the cavity assembly rotates, the hinge protrusion 620 rotates relative to the cam housing 610.

The rotation cam 630 is disposed at the other portion of the hinge protrusion 620 disposed in the cam housing 610. When the hinge protrusion 620 rotates upon the rotation of the door, the rotation cam 630 also rotates together with the hinge protrusion 620. The rotation cam 630 includes a cam groove 631 on a side opposite to the hinge protrusion 620. The cam groove 631 can be formed by recessing a portion of the rotation cam 630 into a predetermined shape.

The movable cam 640 is moved in a length direction of the cam housing 610 by the rotation of the rotation cam 630. A cam protrusion 641 is formed on a side of the movable cam 640 facing the rotation cam 630. That is, the cam protrusion 641 faces the cam groove 631. The cam protrusion 641 can be formed by protruding a portion of the movable cam 640 into a shape corresponding to the shape of the cam groove 631.

The elastic member 650 applies an elastic force to the movable cam 640 to push the movable cam 640 against the rotation cam 630. The elastic member 650 is longitudinally disposed in the cam housing 610. A coil spring can be used as the elastic member 650. In this case, one end of the coil spring may be supported on an end of the cam housing 610 opposite to the hinge protrusion 620, and the other end of the coil spring may be supported on the movable cam 640.

An exemplary operation of the ventilation hooded microwave oven will now be described in detail with reference to the accompanying drawings according to the fourth embodiment.

Figure 24:
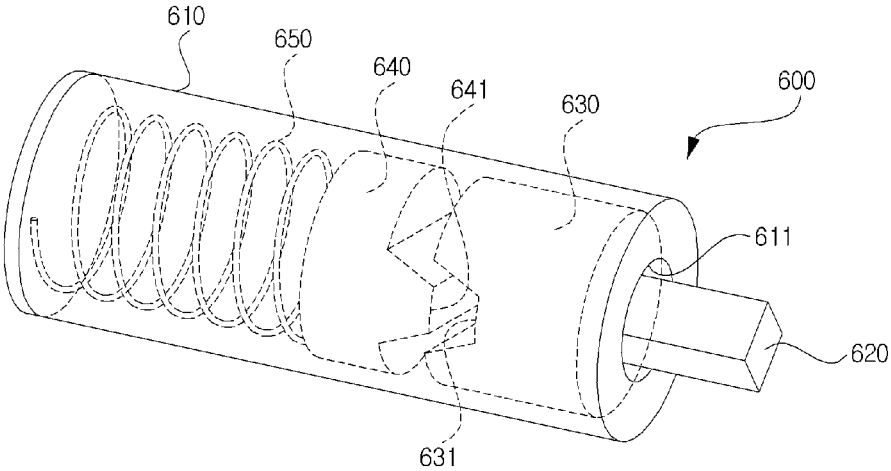
FIGS. 24 and 25 are perspective views illustrating how the cam hinge operates when a door of the ventilation hooded microwave oven is opened and closed according to the fourth embodiment.
Figure 25:
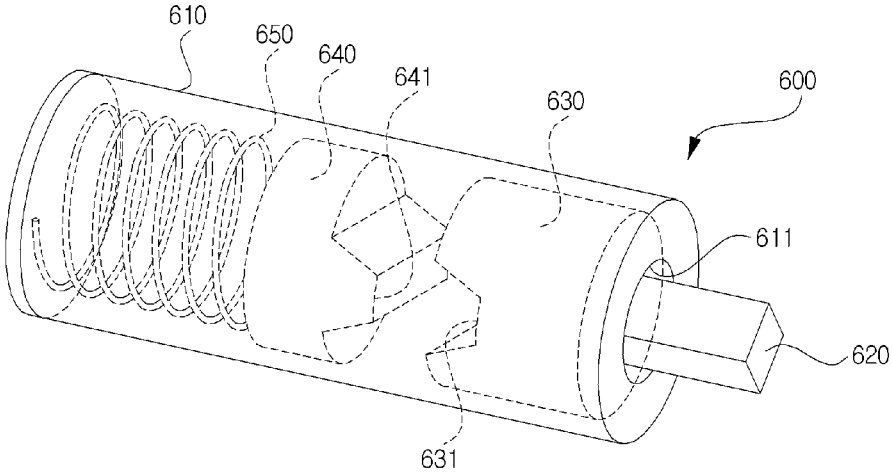

FIGS. 24 and 25 are perspective views illustrating how the cam hinge 600 operates when the door of the ventilation hooded microwave oven is opened and closed according to the fourth embodiment.

When the cooking chamber of the cavity assembly is closed by the door (i.e., when the door does not rotate relative to the cavity assembly), the cam protrusion 641 is in the cam groove 631, and the rotation cam 630 and the movable cam 640 are fully in contact with each other as shown in FIG. 23. Therefore, the rotation cam 630 does not freely rotate so that the door can be reliably held in the closed position, and the closed state of the cooking chamber can be reliably maintained.

When a user pulls the door in an upwardly sloped direction, the lower end of the door is rotated upward about the hinge protrusion 620. Therefore, as shown in FIG. 24, the hinge protrusion 620 is rotated clockwise, and thus the cam protrusion 641 of the movable cam 640 departs from the cam groove 631 of the rotation cam 630.

The elastic member 650 pushes the movable cam 640 toward the rotation cam 630. Therefore, if the user stops pulling of the door before the cam protrusion 641 fully departs from the cam groove 631 (i.e., before the door rotates about the hinge protrusion 620 by more than a predetermined angle), the cam protrusion 641 of the movable cam 640 is moved back into the cam groove 631 of the rotation cam 630 by the elastic member 650. That is, the lower end of the door rotates down about the hinge protrusion 620, and thus the cooking chamber is closed again.

However, if the user does not stop pulling of the door until the door rotates about the hinge protrusion 620 by more than the predetermined angle, the cam protrusion 641 fully departs from the cam groove 631, and thus the top surface of the cam protrusion 641 makes contact with the bottom surface of the rotation cam 630. Therefore, although the elastic member 650 pushes the movable cam 640 toward the rotation cam 630, the rotation cam 630 is not rotated owing to, for example, a frictional force between the top surface of the cam protrusion 641 and the bottom surface of the rotation cam 630. That is, the door does not freely rotate down about the hinge protrusion 620 to close the cooking chamber.

INDUSTRIAL APPLICABILITY

According to the present disclosure, the ventilation hooded microwave oven and the cooling system for the ventilation hooded microwave oven have good industrial applicability owing to the following advantages.

In the present disclosure, the cooking chamber can be opened and closed by rotating up or down the lower end portion of the door about the upper end portion of the door. Therefore, after rotating up the door to open the cooking chamber, left and right outer spaces of the ventilation hooded microwave oven can be freely used, thereby increasing efficiency in utilization of the space of a kitchen where the ventilation hooded microwave oven is placed.

Furthermore, owing to the interference preventing portion formed on an upper portion of the door into a shape corresponding to the shape of the vent grill used to guide air discharged from the cavity assembly of the microwave oven, interference between the door and the vent grill can be prevented when the door is rotated up or down to open or close the cooking chamber of the microwave oven.

Furthermore, electric components of the electric component room can be repaired or replaced through the service opening formed in a front side of the cavity assembly. Therefore, rapid repair and simple maintenance of the ventilation hooded microwave oven can be possible.

Furthermore, the size of the vent passage can be practically reduced owing to the air guides, and the saved space can be used for the electric component room. That is, although the size of the vent passage is reduced to allocate sufficiently large space for the electric component room, air can be smoothly discharged from the cavity assembly through the vent passage.

In addition, components of the cavity assembly are connected to the display unit installed in the door by laying the lead wire between the components and the display unit through a gap between the vent grill and the lead wire cap. Therefore, the lead wire can be reliably protected, and thus the ventilation hooded microwave oven can operate reliably.

Moreover, the door and the door handle are cooled by flowing air therethrough. Therefore, accidents resulting from extreme temperature of the door and the door handle can be prevented, and the display unit disposed at the door can be prevented from being damaged by heat.

The invention claimed is:

1. A ventilation hooded microwave oven having a cavity assembly and a door, the cavity assembly having a cooking chamber for cooking food and an electric component room in which a plurality of electric components is disposed, the door having a door handle at a front side and being rotatably attached to the cavity assembly such that a lower end portion of the door is rotatable upward or downward about an upper end portion of the door to open or close the cooking chamber, the ventilation hooded microwave oven being characterized in that the ventilation hooded microwave oven comprises:

a cooling fan assembly generating power so as to force air to flow into and out of the door and then into and out of the cavity assembly;

a vent grill at a front side of the cavity assembly so as to guide air flowing from the door to the cavity assembly and to guide air discharged from the cavity assembly;

an interference preventing portion at a rear side of the door so as to prevent structural interference between the door and the vent grill when the door is rotated to selectively close and open the cooking chamber; wherein the interference preventing portion is formed by cutting one side of the door into a shape corresponding to the vent grill, wherein the vent grill comprises a suction passage guiding air to the cavity assembly, and a discharge passage guiding air and fumes discharged from the cavity assembly, and a lead wire cap detachably inserted in the vent grill with a wire accommodation gap between the discharge passage and the lead wire cap.

2. The ventilation hooded microwave oven according to claim 1, wherein the cooling fan assembly is disposed at a front upper portion of the cavity assembly in front of the electric component room so as to place a suction portion of the cooling fan assembly close to an air inlet portion of the cavity assembly, and to direct air discharged through a discharge portion of the cooling fan assembly toward the electric component room.

3. The ventilation hooded microwave oven according to claim 1, wherein air discharged from the cavity assembly is guided along a discharge passage disposed in the lead wire cap, and a lead wire is laid from the cavity assembly into the door through the wire accommodation gap between the vent grill and the lead wire cap.

4. A ventilation hooded microwave oven having a cavity assembly and a door, the cavity assembly having a cooking chamber for cooking food and an electric component room in which a plurality of electric components is disposed, the door having a door handle at a front side and being rotatably attached to the cavity assembly such that a lower end portion of the door is rotatable upward or downward about an upper end portion of the door to open or close the cooking chamber, the ventilation hooded microwave oven being characterized in that the ventilation hooded microwave oven comprises:

a cooling fan assembly generating power so as to force air to flow into and out of the door and then into and out of the cavity assembly;

a vent grill at a front side of the cavity assembly so as to guide air flowing from the door to the cavity assembly and to guide air discharged from the cavity assembly; and an interference preventing portion at a rear side of the door so as to prevent structural interference between the door and the vent grill when the door is rotated to selectively close and open the cooking chamber, wherein the interference preventing portion is formed by cutting one side of the door into a shape corresponding to the vent grill, wherein the vent grill comprises a suction passage guiding air to the cavity assembly, and a discharge passage guiding air and fumes discharged from the cavity assembly, the ventilation hooded microwave oven configured such that air introduced into the door through an inlet hole of the door and circulated in the door to cool the door is discharged through an outlet hole of the door, and subsequently introduced into the cavity assembly through an inlet portion of the cavity assembly.

5. The ventilation hooded microwave oven according to claim 4, wherein the cooling fan assembly is disposed at a front upper portion of the cavity assembly in front of the electric component room so as to place a suction portion of the cooling fan assembly close to the inlet portion of the cavity assembly through which air flows from the door to the cavity assembly, and to direct air discharged through the discharge passage of the cooling fan assembly toward the electric component room.

6. The ventilation hooded microwave oven according to claim 4, further comprising a first air duct forming a passage, by which after the electric components of the electric component room are cooled by air introduced through a front-side inlet portion of the cavity assembly by the cooling fan assembly, the air is guided from the electric component room to the cooking chamber through the passage of the first air duct.

7. The ventilation hooded microwave oven according to claim 6, further comprising a second air duct forming a passage so as to allow air circulated in the cooking chamber and discharged from the cooking chamber to be discharged through a front-side outlet portion of the cavity assembly.

8. The ventilation hooded microwave oven according to claim 4, wherein the outlet hole is disposed at a side of the interference preventing portion, and the suction passage communicates with the outlet hole when the cooking chamber is closed by the door.

9. The ventilation hooded microwave oven according to claim 4, wherein the inlet hole is disposed at a side of an upper end portion of the door farthest from the outlet hole.

10. The ventilation hooded microwave oven according to claim 4, wherein the interference preventing portion is covered with a front member forming a front exterior of the door.

11. The ventilation hooded microwave oven according to claim 10, wherein the front member is a front glass.

12. The ventilation hooded microwave oven according to claim 10, wherein a lead wire is laid from a wire accommodation gap into the door through a lead wire opening located at a side of the vent grill.

13. The ventilation hooded microwave oven according to claim 12, wherein the lead wire laid into the door is connected to a display unit configured to receive operational commands and display information about operation of the ventilation hooded microwave oven.

14. The ventilation hooded microwave oven according to claim 4, further comprising an air guide at a top portion of the cavity assembly to separate the electric component room from a vent passage.

15. The ventilation hooded microwave oven according to claim 14, wherein the air guide separates the electric component room and the vent passage in a manner such that the electric component room becomes wider toward the front side of the cavity assembly, and the vent passage becomes narrower toward the front side of the cavity assembly.

16. The ventilation hooded microwave oven according to claim 14, wherein the air guide is formed of a metal, and a front portion of the air guide is sloped toward the vent passage.

17. The ventilation hooded microwave oven according to claim 4, wherein an opening is disposed at a bottom surface of the electric component room and configured to guide air circulated in the electric component room to cool the electric components into the cooking chamber when the cooling fan assembly operates.

* * * * *